US009947986B1

(12) United States Patent
Aster

(10) Patent No.: US 9,947,986 B1
(45) Date of Patent: Apr. 17, 2018

(54) REACTIVE POWER COMBINERS AND DIVIDERS INCLUDING NESTED COAXIAL CONDUCTORS

(71) Applicant: David B. Aster, Spokane Valley, WA (US)

(72) Inventor: David B. Aster, Spokane Valley, WA (US)

( * ) Notice: Subject to any disclaimer, the term of this patent is extended or adjusted under 35 U.S.C. 154(b) by 0 days.

(21) Appl. No.: 15/582,533

(22) Filed: Apr. 28, 2017

Related U.S. Application Data

(63) Continuation-in-part of application No. 15/043,570, filed on Feb. 14, 2016, now Pat. No. 9,673,503, and (Continued)

(51) Int. Cl.
*H01P 5/12* (2006.01)
*H01P 5/19* (2006.01)
(Continued)

(52) U.S. Cl.
CPC ..... *H01P 5/19* (2013.01); *H01P 3/06* (2013.01); *H01P 11/001* (2013.01)

(58) Field of Classification Search
CPC ..... H01P 5/12; H01P 5/19; H01P 3/06; H01P 11/001
See application file for complete search history.

(56) References Cited

U.S. PATENT DOCUMENTS 2,946,965 A 7/1960 Albanese
3,931,587 A 1/1976 Harp et al.
(Continued)

OTHER PUBLICATIONS

Jul. 20, 2017 office action in U.S. Appl. No. 15/078,086.
(Continued)

*Primary Examiner* — Robert J Pascal
*Assistant Examiner* — Kimberly Glenn
(74) *Attorney, Agent, or Firm* — Malhotra Law Firm, PLLC; Deepak Malhotra

(57) ABSTRACT

A power divider/combiner includes a main conductor defining an axis and having an outer surface; an input connector, at a front end, having a center conductor, electrically coupled to the main conductor and having an axis aligned with the main conductor axis; a first hollow cylindrical conductor having an open end facing rearwardly, having an inner cylindrical surface, the main conductor being received in and spaced apart from the inner cylindrical surface, the first hollow cylindrical conductor being electrically coupled to the second conductor of the input connector; a second hollow cylindrical conductor having an open end facing forwardly, the first cylindrical conductor being received in and spaced apart from the inner cylindrical surface of the second cylindrical conductor; a third hollow cylindrical conductor having an open back end facing rearwardly, the second cylindrical conductor being received in and spaced apart from the inner cylindrical surface of the third cylindrical conductor; and a plurality of output connectors having respective axes that are perpendicular to the main conductor axis, the output connectors being angularly spaced apart relative to each other, the output connectors having center conductors electrically coupled to the third cylindrical conductor. Methods are also provided.

20 Claims, 20 Drawing Sheets

Related U.S. Application Data a continuation-in-part of application No. 15/078,086, filed on Mar. 23, 2016.

(60) Provisional application No. 62/140,390, filed on Mar. 30, 2015.

(51) Int. Cl.
*H01P 3/06* (2006.01)
*H01P 11/00* (2006.01)

(56) References Cited

U.S. PATENT DOCUMENTS

| | | | | |
|---|---|---|---|---|
| 4,032,865 | A | 6/1977 | Harp et al. | |
| 4,035,746 | A * | 7/1977 | Covington, Jr. | H01P 5/12 333/125 |
| 4,152,680 | A | 5/1979 | Harrison | |
| 4,188,590 | A | 2/1980 | Harp et al. | |
| 4,238,747 | A | 12/1980 | Harp et al. | |
| 4,266,208 | A | 5/1981 | Cornish | |
| 4,453,139 | A | 6/1984 | Labaar | |
| 4,598,254 | A | 7/1986 | Saito et al. | |
| 4,694,260 | A | 9/1987 | Argintaru et al. | |
| 4,700,145 | A | 10/1987 | Yelland | |
| 4,835,496 | A | 5/1989 | Schellenberg et al. | |
| 5,142,253 | A * | 8/1992 | Mallavarpu | H01P 5/12 333/127 |
| 5,389,890 | A | 2/1995 | Burrage | |
| 5,644,272 | A | 7/1997 | Dabrowski | |
| 5,777,527 | A | 7/1998 | Sanders | |
| 5,784,033 | A | 7/1998 | Boldissar, Jr. | |
| 5,847,625 | A | 12/1998 | Gillette | |
| 6,005,450 | A | 12/1999 | Schmidt et al. | |
| 6,018,277 | A | 1/2000 | Vaisanen | |
| 6,919,776 | B1 | 7/2005 | Mobius et al. | |
| 7,102,459 | B1 | 9/2006 | Arnold et al. | |
| 7,215,218 | B2 | 5/2007 | Burns et al. | |
| 7,397,328 | B2 | 7/2008 | Yasuda et al. | |
| 7,468,640 | B2 | 12/2008 | Nosaka | |
| 7,479,850 | B2 | 1/2009 | Kearns et al. | |
| 8,120,444 | B2 * | 2/2012 | Haunberger | H01P 5/12 333/121 |
| 8,508,313 | B1 | 8/2013 | Aster | |
| 9,065,163 | B1 | 6/2015 | Wu | |
| 9,673,503 | B1 | 6/2017 | Aster | |
| 2013/0335162 | A1 | 12/2013 | Sun | |

OTHER PUBLICATIONS

Jul. 14, 2017 office action in U.S. Appl. No. 15/493,074.
Jul. 11, 2017 office action in U.S. Appl. No. 15/493,591.
Semi-Flexible Air Dielectric Coaxial Cables and Connectors, 50 Ohms, EIA Standard RS-258, Mar. 1962, Table 1 and pp. 5-6.
Unpublished U.S. Appl. No. 15/078,086, filed Mar. 23, 2016.
Unpublished U.S. Appl. No. 15/493,074, filed Apr. 20, 2017.
Unpublished U.S. Appl. No. 15/493,591, filed Apr. 21, 2017.
Unpublished U.S. Appl. No. 15/614,572, filed Jun. 5, 2017.
Kenneth J. Russell, 'Microwave power combining techniques,' IEEE Transactions on Microwave Theory and Techniques, May 1979, pp. 472-478.
Clayton R. Paul, Analysis of Multiconductor Transmission Lines, John Wiley & Sons, New York, New York, 1994, pp. 219-222.
G. C. Temes and S. K. Mitra, Modern Filter Theory and Design, John Wiley & Sons, New York, New York, 1973, pp. 276-284.
G. C. Temes and S. K. Mitra, Modern Filter Theory and Design, John Wiley & Sons, New York, New York, 1973, pp. 306-308.
"Choosing the Best Power Divider for the Task of Signal Combining" retrieved from: http://www.microlab.fxr.com/resource-library?brand=Microlab&go=application_notes, downloaded and printed on Feb. 6, 2016 (6 pages).
"Reactive vs. Wilkinson Splitters" retrieved from: http://www.microlab.fxr.com/resource-library?brand=Microlab &go=application_notes, downloaded and printed on Feb. 6, 2016 (2 pages).
"Dividers & Combiners" retrieved from: http://www.microlab.fxr.com/resource-library?brand=Microlab&go=application_notes, downloaded and printed on Feb. 6, 2016 (4 pages).
Wilkinson, Ernest J., An N-Way Hybrid Power Divider, Jan. 1960, pp. 116-118, IRE Transactions on Microwave Theory and Techniques.
Horton, M.C., and Wenzel, R.J., General Theory and Design of Optimum Quarter-Wave TEM Filters, May 1965, pp. 316-327, IEEE Transactions on Microwave Theory and Techniques.
First Office Action, dated Jul. 5, 2016, in U.S. Appl. No. 15/043,570, invented by the inventor hereof.
Second Office Action, dated Nov. 17, 2016, in U.S. Appl. No. 15/043,570, invented by the inventor hereof.
Matthaei, Young, and Jones, Microwave Filters, Impedance-Matching Networks, and Coupling Structures, 1980, p. 302, Artech House Books.
Patzelt and Arndt, Double-Plane Steps in Rectangular Waveguides and their Application for Transformers, Irises, and Filters, pp. 772-776, May 5, 1982, IEEE Transactions on Microwave Theory and Techniques.
Whinnery, Jamieson, and Robbins, Coaxial-Line Discontinuities, p. 695, Nov. 1944, Proceedings of the I.R.E.

* cited by examiner

Section 3 - 3

Section 9 - 9

200 →

300 →

400 →

$Z_S = Z_L = 50$ ohms
$Z_1$ = 36.8 ohms
$Z_2$ = 19.1 ohms
$Z_3$ = 7.7 ohms
$Z_{SH}$ = 7.1 ohms
$Z_L/N$ = 5.0 ohms $$\begin{bmatrix} \bar{B} \\ \bar{D} \end{bmatrix} = \mathbf{M} \begin{bmatrix} \bar{A} \\ \bar{C} \end{bmatrix};$$

$$\rho_1 = |\rho| e^{j\phi_1} = D_0 / C_0$$

$$\rho_2 = |\rho| e^{j\phi_2} = B_0 / A_0$$

REACTIVE POWER COMBINERS AND DIVIDERS INCLUDING NESTED COAXIAL CONDUCTORS

CROSS REFERENCE TO RELATED APPLICATION

This is a continuation-in-part of U.S. patent application Ser. No. 15/043,570, filed Feb. 14, 2016, and a continuation-in-part of U.S. patent application Ser. No. 15/078,086, filed Mar. 23, 2016, both of which in turn claim priority to U.S. Provisional Patent Application Ser. No. 62/140,390, filed Mar. 30, 2015, all of which were invented by the inventor hereof and all of which are incorporated herein by reference.

TECHNICAL FIELD

The technical field includes methods and apparatus for summing (or combining) the signals from a microwave antenna array or for combining a number of isolator-protected power sources or for dividing power into a number of separate divided output signals.

BACKGROUND

The communications and radar industries have interest in reactive-type broadband microwave dividers and combiners. Even though not all ports are RF matched, as compared to the Wilkinson power divider/combiner (see Ernest J. Wilkinson, "An N-way hybrid power divider," IRE Trans. on Microwave Theory and Techniques, Jan., 1960, pp. 116-118), the reactive-type mechanical and electrical ruggedness is an advantage for high-power combiner applications. This assumes that the sources to be combined are isolator-protected and of equal frequency, amplitude and phase. Another combiner application is improving the signal-to-noise ratio of faint microwave communication signals using an antenna dish array connected to the reactive power combiner using phase length-matched cables. The signal from each dish antenna sees an excellent "hot RF match" into each of the N combining ports of the reactive power combiner and is therefore efficiently power combined with the other N−1 antenna signals having equal frequency, amplitude, and phase. However, the cable- and antenna-generated thermal noise signal into each port of the N-way power combiner (with uncorrelated phase, frequency and amplitude) sees an effective "cold RF match" and is thus poorly power combined. The signal-to-noise ratio improves for large values of the number of combiner ports N. Still another application is for one of two reactive N-way power dividers to provide a quantity N signals of equal phase, amplitude and frequency as inputs to a set of N broadband amplifiers each with a noise figure X db/MHz. A second high-power N-way reactive power combiner is used to combine the N amplified signals with the benefit of improving the overall total noise figure by several dB.

An example of a reactive combiner/divider is described in U.S. Pat. No. 8,508,313 to Aster, incorporated herein by reference. Broadband operation is achieved using two or more stages of multiconductor transmission line (MTL) power divider modules. An 8-way reactive power divider/combiner 200 of this type is shown in FIGS. 4 and 5 of application Ser. No. 15/043,570. Described as a power divider, microwave input power enters coax port 201, which feeds a two-way MTL divider 202. Input power on the main center conductor 206 (FIG. 6a, Section a1-a1) is equally divided onto two satellite conductors 207 which in turn each feed quarter-wave transmission lines housed in module 203 (FIG. 4). Each of these quarter-wave lines feeds a center conductor 208 (FIG. 6b, Section a2-a2) in its respective four-way MTL divider module 204, power being equally divided onto satellite conductors 209 which in turn feed output coax connectors 205. This may also be described as a two-stage MTL power divider where the first stage two-way divider (Stage B, FIG. 7) feeds a second stage (Stage A, FIG. 7) consisting of two 4-way MTL power dividers, for a total of eight outputs 205 of equally divided power. This two-stage divider network is described electrically in FIG. 7 as a shorted shunt stub ladder filter circuit with a source admittance $Y_S^{(B)}$ and a load admittance $N_S^{(B)} N_S^{(A)} Y_L^{(A)}$. The first-stage (Stage B) quarter-wave shorted shunt stub transmission line characteristic admittances have values $Y_{10}^{(B)}$ and $N_S^{(B)} Y_{20}^{(B)}$, respectively, which are separated by a quarter-wave main line with characteristic admittance value $N_S^{(B)} Y_{12}^{(B)}$. Here the number of satellite conductors $N_S^{(B)}=2$, $N_S^{(A)}=4$ and $Y_{12}^{(B)}$ is the value of the row 1, column 2 element of the 3×3 characteristic admittance matrix $Y^{(B)}$ for the two-way MTL divider (Section a1-a1, FIG. 6). Also, $Y_{10}^{(B)}=Y_{11}^{(B)}+N_S^{(B)} Y_{12}^{(B)}$ and $Y_{20}^{(B)}=Y_{22}^{(B)}+Y_{12}^{(B)}+Y_{23}^{(B)}$. Each quarter-wave transmission line within housing 203 (FIG. 4) has characteristic admittance $Y_T$ and is represented in the equivalent circuit FIG. 7 as a quarter-wave main transmission line with characteristic admittance $N_S^{(B)} Y_T$. The second stage (Stage A) quarter-wave shorted shunt stub transmission line characteristic admittances have values $N_S^{(B)} Y_{10}^{(A)}$ and $N_S^{(B)} N_S^{(A)} Y_{20}^{(A)}$, respectively, which are separated by a quarter-wave main line with characteristic admittance $N_S^{(B)} N_S^{(A)} Y_{12}^{(A)}$. Here $Y_{12}^{(A)}$ is the value of the row 1, column 2 element of the 5×5 characteristic admittance matrix $Y^{(A)}$ for one of the two identical four-way MTL divider modules 204 (FIG. 4) with cross-section a2-a2 in FIG. 6b. A plot of scattering parameters for an octave bandwidth two-stage eight-way divider is shown in FIG. 4c of U.S. Pat. No. 8,508,313. Due to its complexity, the two-stage, three MTL module power divider/combiner as shown in FIGS. 4 and 5 is expensive to fabricate.

SUMMARY

Some embodiments provide a power divider/combiner having an input, a plurality of outputs, and nested unit element conductors, having approximately a 2.7:1 bandwidth, and having a shorter length than non-nested power divider/combiners. For example, some embodiments have a bandwidth of about 0.95 GHz to 2.55 GHz. Other embodiments have a bandwidth of about 0.47 GHz to 1.27 GHz. Still other embodiments have a bandwidth of about 0.40 GHz to 1.08 GHz. Some embodiments provide a reactive 10-way divider/combiner.

Some embodiments provide a power divider/combiner having a front end and a rear end and including a main conductor defining an axis and having an outer surface; an input connector, at the front end, having a center conductor, adapted to be coupled to a signal source, electrically coupled to the main conductor and having an axis aligned with the main conductor axis, and having a second conductor; a first hollow cylindrical conductor having an open end facing rearwardly, having an inner cylindrical surface, and having outer cylindrical surface, the main conductor being received in and spaced apart from the inner cylindrical surface, the first hollow cylindrical conductor being electrically coupled to the second conductor of the input connector; a second hollow cylindrical conductor having an open end facing forwardly, having an inner cylindrical surface, and having outer cylindrical surface, the first cylindrical conductor being received in and spaced apart from the inner cylindrical surface of the second cylindrical conductor; a third hollow cylindrical conductor having an open back end facing rearwardly, having an inner cylindrical surface, and having outer cylindrical surface, the second cylindrical conductor being received in and spaced apart from the inner cylindrical surface of the third cylindrical conductor; and a plurality of output connectors having respective axes that are perpendicular to the main conductor axis, the output connectors being angularly spaced apart relative to each other, the output connectors having center conductors electrically coupled to the third cylindrical conductor.

Other embodiments provide a power divider/combiner having a front end and a rear end and including a main conductor defining an axis and having an outer surface; an input connector, at the front end, having a center conductor, adapted to be coupled to a signal source, electrically coupled to the main conductor and having an axis aligned with the main conductor axis, and having a second conductor; a first hollow cylindrical conductor having an open end facing rearwardly, having an inner cylindrical surface, and having outer cylindrical surface, the main conductor being received in and spaced apart from the inner cylindrical surface, the first hollow cylindrical conductor being electrically coupled to the second conductor of the input connector; a second hollow cylindrical conductor having an open end facing forwardly, having an inner cylindrical surface, and having outer cylindrical surface, the first cylindrical conductor being received in and spaced apart from the inner cylindrical surface of the second cylindrical conductor; a third hollow cylindrical conductor having an open back end facing rearwardly, having an inner cylindrical surface, and having outer cylindrical surface, the second cylindrical conductor being received in and spaced apart from the inner cylindrical surface of the third cylindrical conductor, the outer surface of the main center conductor and the inner surface of first cylindrical conductor, the outer surface of the first cylindrical conductor and the inner surface of the second cylindrical conductor, and the outer surface diameter of second cylindrical conductor and the inner surface of the third cylindrical conductor define respective unit element coaxial transmission lines, and the first, second and third hollow cylindrical conductors having respective cylinder axes that are coincident with the axis of the main conductor; and a plurality of output connectors having respective axes that are perpendicular to the main conductor axis, the output connectors being angularly spaced apart relative to each other, the output connectors having center conductors electrically coupled to the third cylindrical conductor.

Still other embodiments provide a method of manufacturing a power divider/combiner having a front end and a rear end, the method including providing a first hollow cylindrical conductor having an open end facing rearwardly, having an inner cylindrical surface, and having outer cylindrical surface, and providing an input port flange forward of the first cylindrical conductor, electrically coupled to and secured to the first cylindrical conductor; providing a main conductor defining an axis and having an outer surface inside the inner cylindrical surface, spaced apart from the inner cylindrical surface; securing an input connector to the input port front flange, the input connector having a center conductor and being adapted to be coupled to a signal source, electrically coupling the center conductor of the input connector to the main conductor, coupling a second conductor of the input connector to the input port flange; providing a second hollow cylindrical conductor having an open end facing forwardly, having an inner cylindrical surface, and having outer cylindrical surface, and providing a rear flange rearward of the second cylindrical conductor, electrically coupled to and secured to the second cylindrical conductor; providing a third hollow cylindrical conductor having an open back end facing rearwardly, having an inner cylindrical surface, and having outer cylindrical surface; receiving the first cylindrical conductor and center conductor in the third cylindrical conductor; providing a plurality of output connectors having respective axes that are perpendicular to the main conductor axis, the output connectors being angularly spaced apart relative to each other, the output connectors having center conductors electrically coupled to the third cylindrical conductor and having respective second conductors electrically coupled to the ground conductor proximate the back end of the third cylindrical conductor; and inserting the second cylindrical conductor between the first and third cylindrical conductors, spaced apart from the inner surface of the third conductor and the outer surface of the first conductor.

DETAILED DESCRIPTION OF THE ILLUSTRATED EMBODIMENTS

Figure 1:
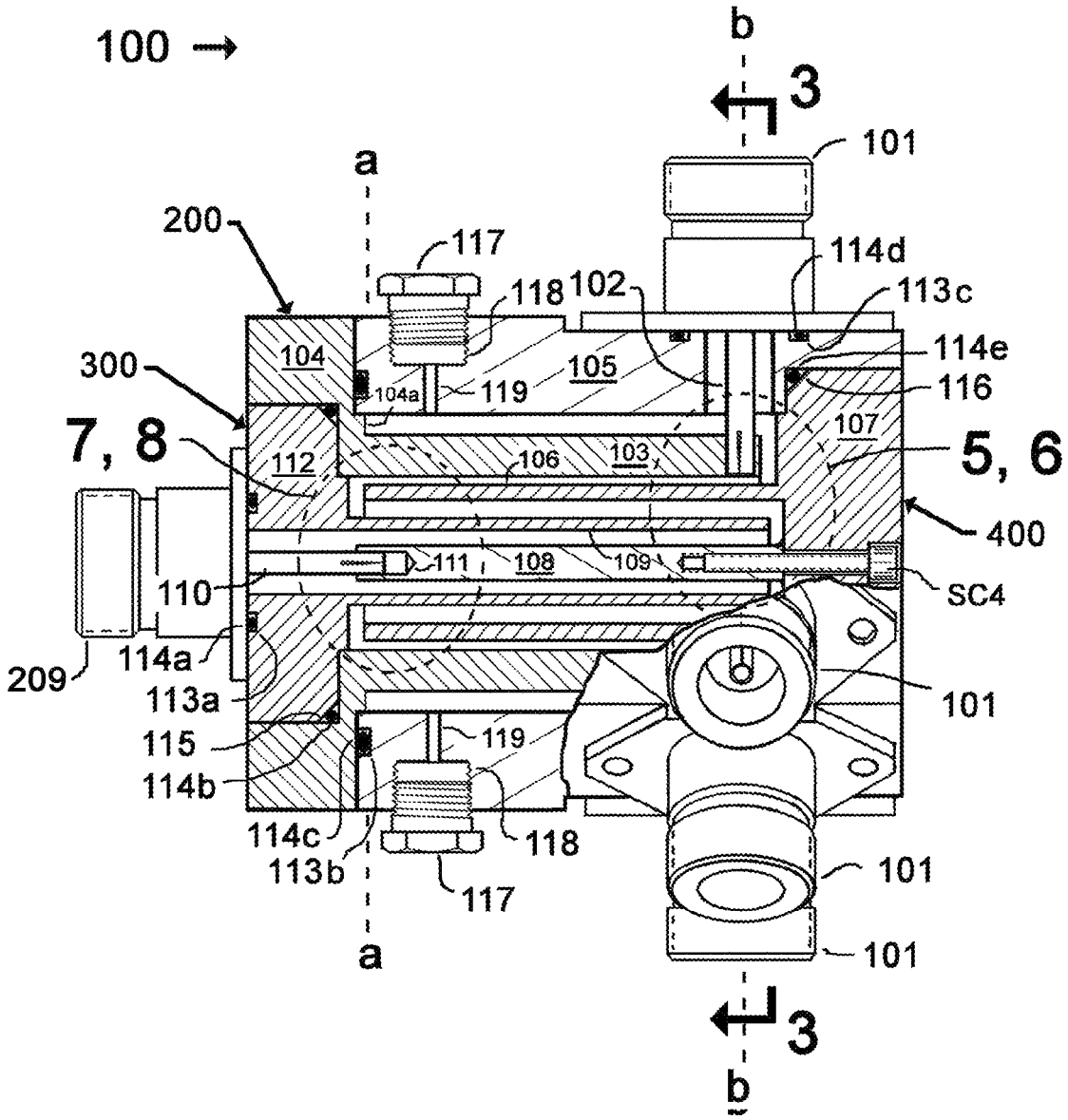
FIG. 1 is a side view of a power divider/combiner in accordance with various embodiments, partly in section.

Attention is directed to U.S. patent application Ser. No. 15/493,074, invented by the inventor hereof, filed Apr. 20, 2017, and incorporated herein by reference. Attention is also directed to U.S. patent application Ser. No. 15/493,591, invented by the inventor hereof, filed Apr. 21, 2017, and incorporated herein by reference. FIG. 1 shows a microwave power divider 100, which can alternatively be used as a power combiner, in accordance with various embodiments. It will hereinafter be referred to as a power divider-combiner 100.

Hereinafter described as if for use as a power divider, the power divider-combiner 100 has (see FIGS. 1 and 17) a single main input port flange 112, and a quantity N of output port connectors 101. It is to be understood that, for convenience, the terms "input" and "output", when used herein and in the claims, assume that the divider-combiner is being used as a power divider. The roles of the inputs and outputs are reversed when the divider-combiner is being used as a power combiner.

In the illustrated embodiments, the power divider-combiner 100 (see FIG. 1) has, at a forward end, an input RF connector 209 which is Type N female. Other connector types, such as Type N male, SC (male or female), LC (male or female), TNC (male or female), or SMA (male or female), for example, could be employed. In the illustrated embodiments, the divider-combiner 100 of FIG. 1 includes a center conductor 110.

The power divider-combiner 100 has (see FIG. 1, 2, 3, or 17), in the illustrated embodiments, ten Type N (female) connectors for the output ports 101. Other types of output and input RF connectors are possible.

The power divider-combiner 100 includes a cylindrical conductor 103 defining, in some embodiments, the shape of or the general shape of a hollow cylinder (see FIGS. 4, 9, 14, and 21). Each output RF connector 101 has a center conductor 102 electrically connected with an outer end of the conductor 103.

Figure 5:
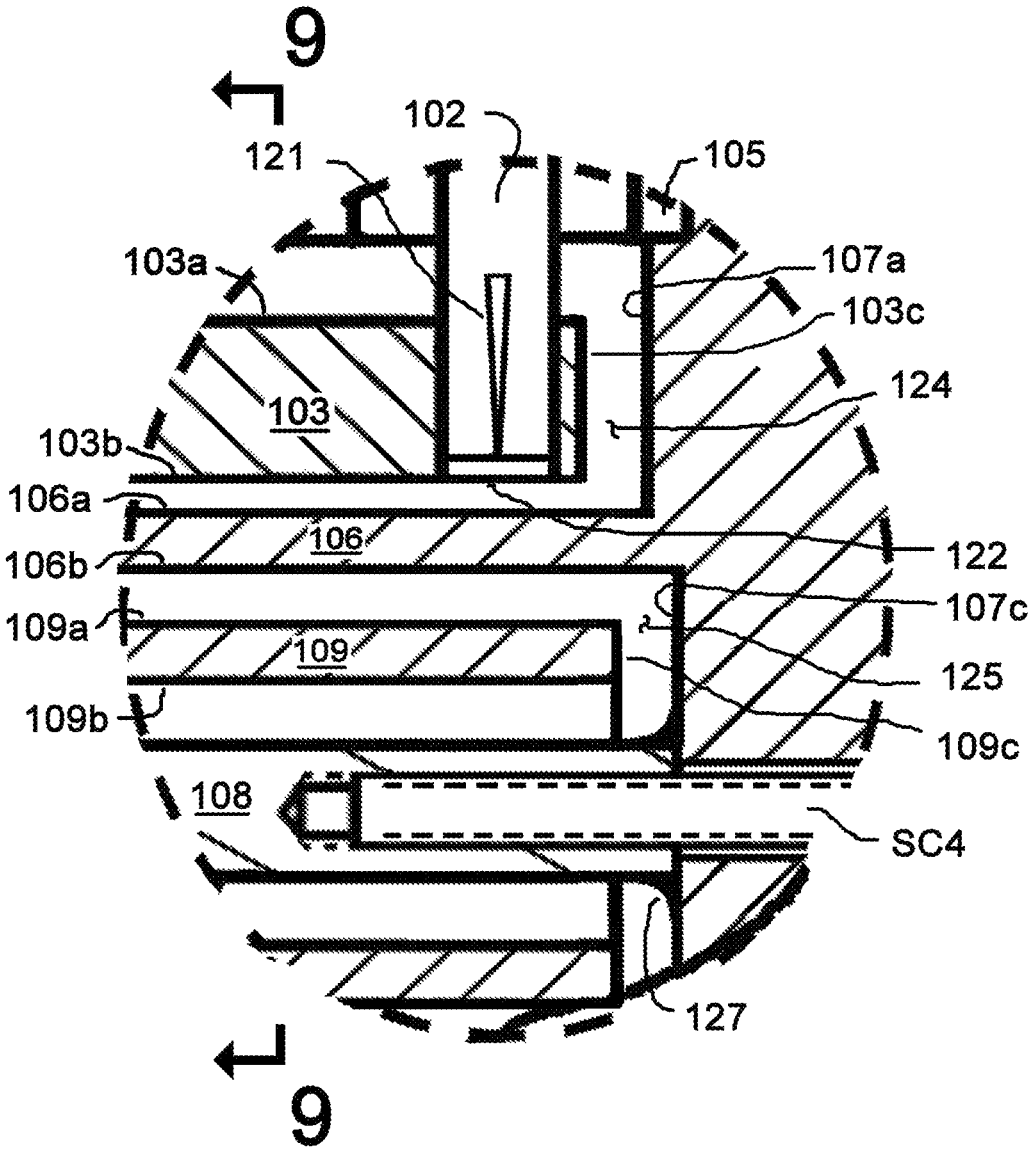
FIG. 5 is a partial cut-away view of the divider/combiner of FIG. 1 or FIG. 2 showing a connection point.
Figure 6:
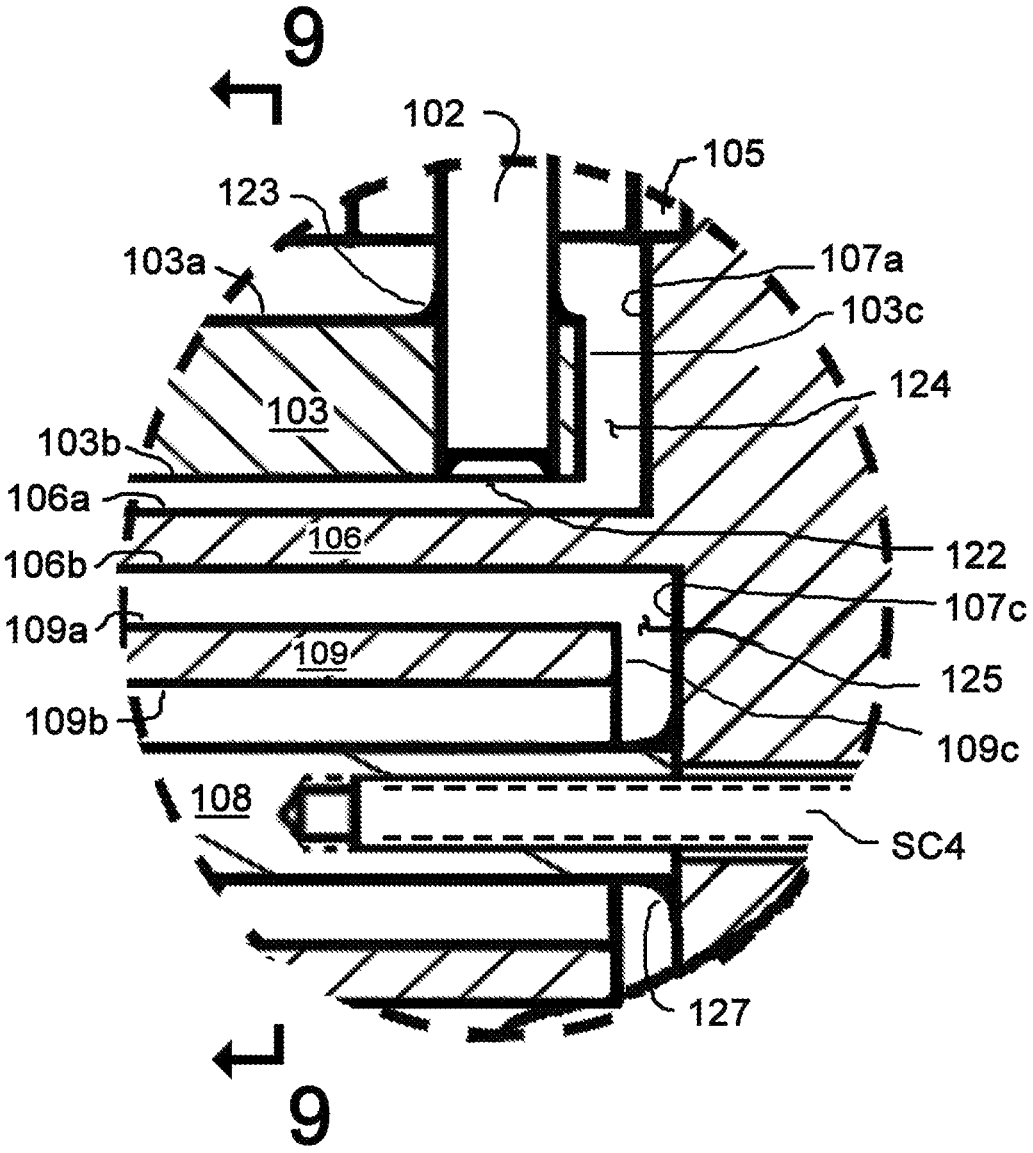
FIG. 6 is a partial cut-away view of the divider/combiner of FIG. 1 or FIG. 2 in accordance with alternative embodiments.

The conductor 103 has a rear end including bores 122 (FIG. 14) extending from the outer cylindrical surface of the center conductor 103 to the inner cylindrical surface of the conductor 103. FIG. 5 shows center conductor 102 with a slotted end 121 distal from the output port 101 (see FIG. 3) and compression fit into one of the receiving bores 122. FIG. 6 shows an alternative connection. In the embodiments of FIG. 6, the center conductor 102 is attached with solder or braze alloy 123 into the bore 122 to form the electrical and thermal connection to the conductor 103.

Figure 2:
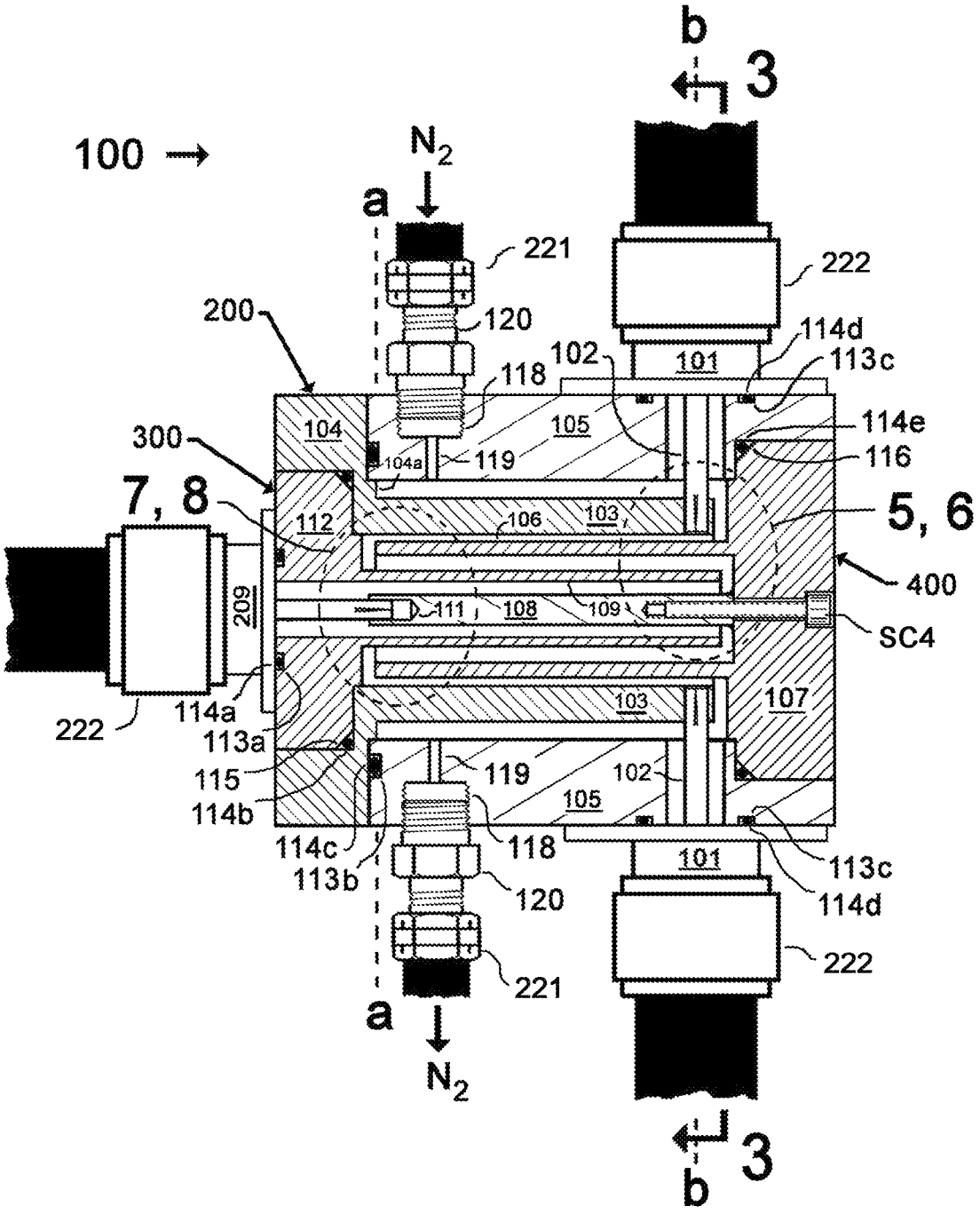
FIG. 2 is the power divider/combiner shown in FIG. 1 with coaxial cables attached and with both plugs replaced with pressure valves to allow the introduction of a gas.
Figure 7:
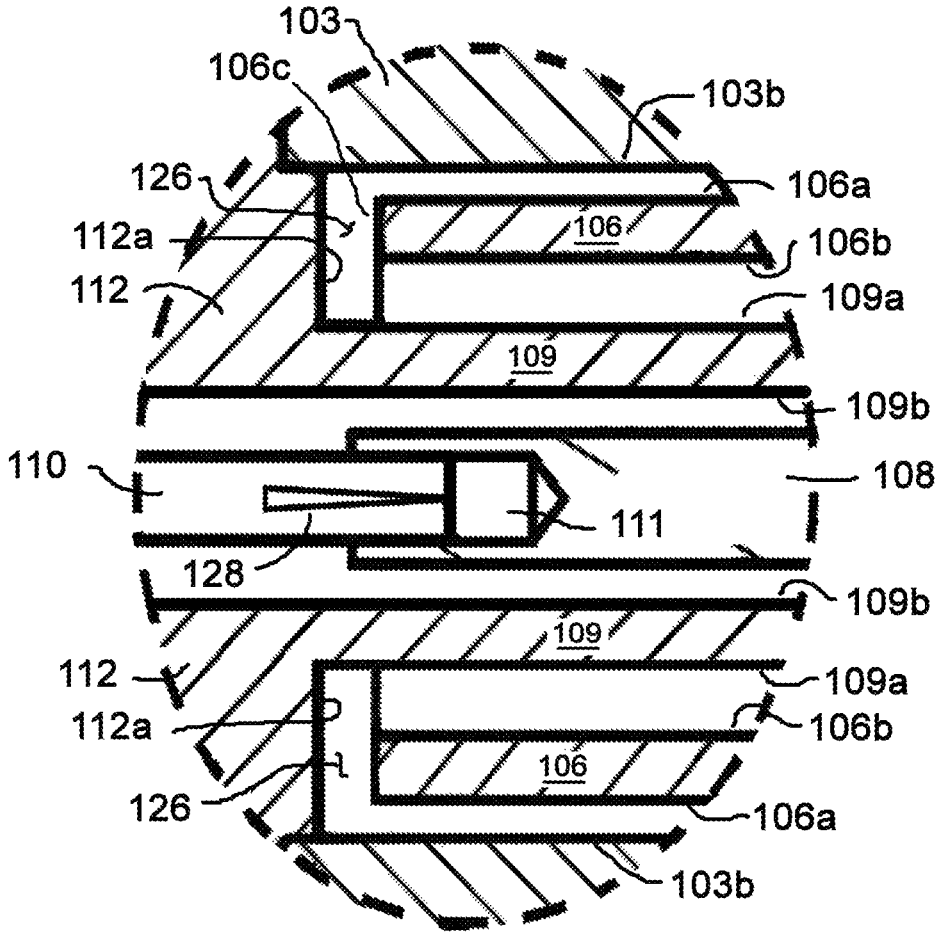
FIG. 7 is a partial cut-away view of the divider/combiner of FIG. 1 or FIG. 2 showing a connection point.
Figure 8:
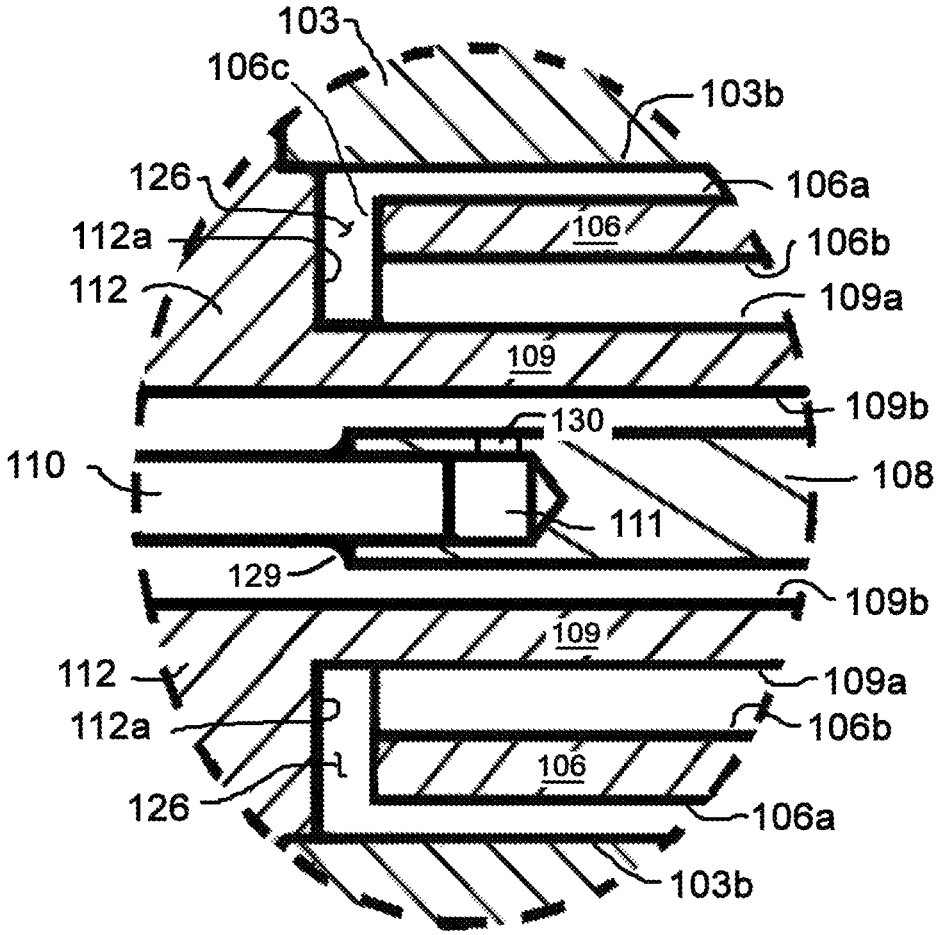
FIG. 8 is a partial cut-away view of the divider/combiner of FIG. 1 or FIG. 2 in accordance with alternative embodiments.
Figure 9:
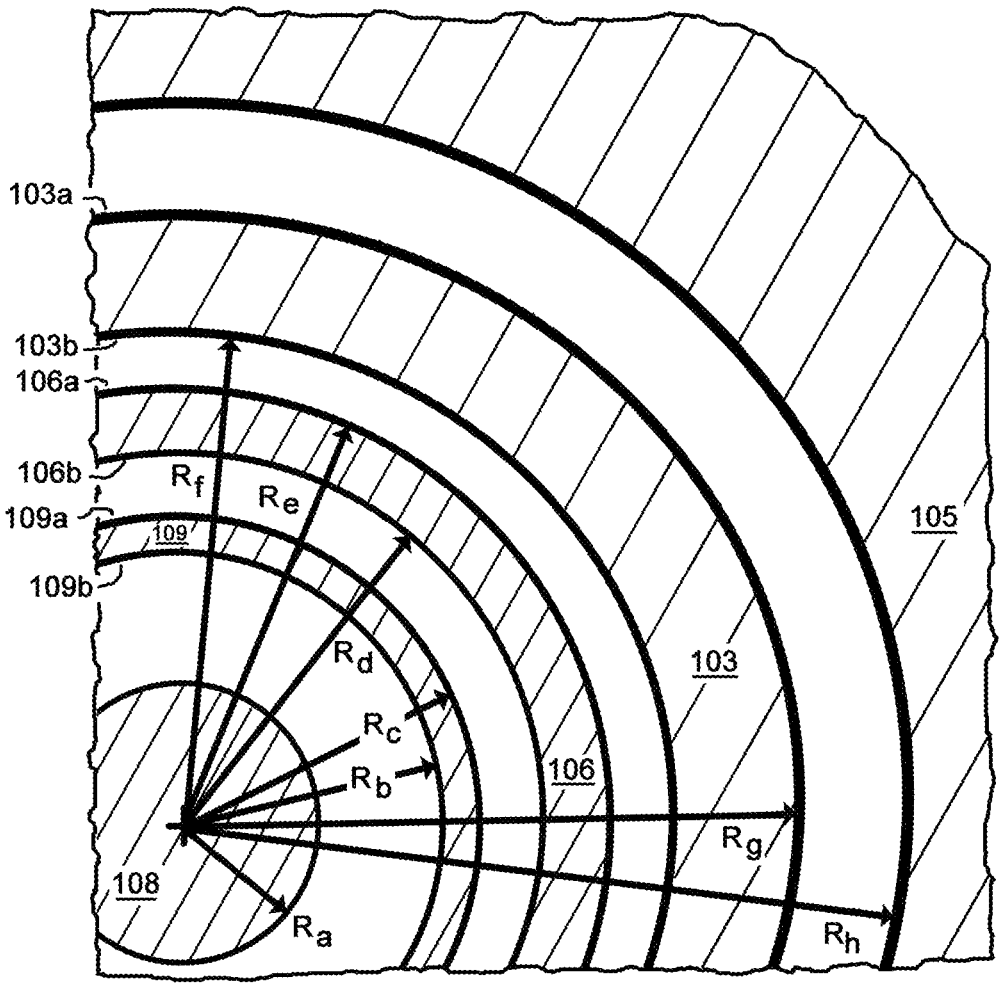
FIG. 9 is a sectional view taken along 9-9 of FIG. 5 or FIG. 6.

The power divider-combiner 100 includes (see FIG. 1, 2, 4, 5 or 6, 7 or 8, 9, 11, and 21) a main center conductor 108 which is cylindrical in the illustrated embodiments; however, other shapes are possible. FIG. 7 shows an embodiment in which the forward end of the main center conductor 108 includes a receiving bore 111. The input center conductor 110 has a slotted end 128 distal from the input port 209 (FIG. 1, 11) and compression fit into the receiving bore 111, in the illustrated embodiments. FIG. 8 shows an alternative connection. In the embodiments of FIG. 8, the center conductor 110 is attached with solder or braze alloy 129 into bore 111 to form the electrical and thermal connection to main center conductor 108. Also embodied in FIG. 8 is a bore 130 in the sidewall of center conductor 108 which allows pressure relief out of bore 111 during soldering or brazing. A customer's coax cables 222 are shown in FIG. 2 making connection to the input port RF connector 209 and to each output port RF connector 101.

The power divider-combiner 100 includes a cylindrical conductor 106 defining, in some embodiments, the shape of or the general shape of a hollow cylinder (see FIGS. 4, 9, 16, and 21) and having an inner cylindrical surface 106*b* with a cylinder axis, an outer cylindrical surface, and a forward facing opening. The power divider-combiner 100 further includes a cylindrical conductor 109 defining, in some embodiments, the shape of or the general shape of a hollow cylinder (see FIGS. 4, 9, 15, and 21) and having an inner cylindrical surface 109*b* with a cylinder axis, an outer cylindrical surface 109*a*, and a rearward facing opening. At least a portion of the conductor 109 is received in the conductor 106, via its forward facing opening, with a gap between inner surface 106*b* and outer surface 109*a*.

The power divider-combiner 100 further includes, at a rearward end, an electrically and thermally conducting rear flange 107 to which the rearward end of main center conductor 108 electrically and mechanically connects, and to which the rearward end of conducting cylinder 106 also connects. In the embodiments shown in FIGS. 1, 2, 5, 6, 11, and 16 the cylinder conductor 106 and rear flange 107 are shown as one piece, hereafter referred to as cylinder-flange 400 (see FIG. 16). Other embodiments are possible, such as a soldered or brazed connection. The flange 107 includes an alignment hub outer surface 107*b* and a radial line conducting surfaces 107*a* and 107*c*.

In the illustrated embodiments, there is a gap between the inner surface 109*b* and the outer surface of the main conductor 108.

Figure 15:
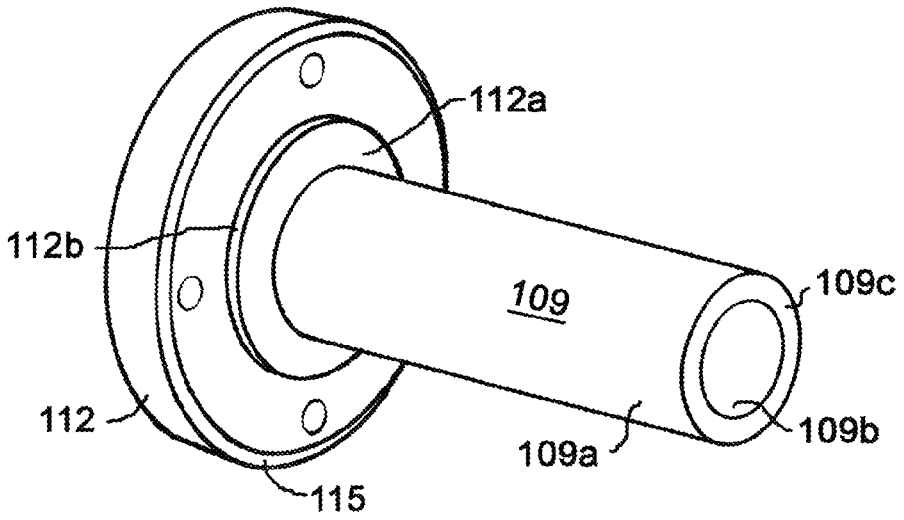
FIG. 15 is a perspective view of a conductor included in the divider/combiner of FIG. 1.

The forward end of the cylinder conductor 109 electrically and mechanically connects to the input port flange 112, hereafter referred to as cylinder-flange 300 (see FIG. 1 or 2, and 15). In the embodiments shown in FIGS. 1, 2, 7, 8, 11, and 15 the cylinder conductor 109 and conducting flange 112 are shown as one piece. Other embodiments are possible, such as a soldered or brazed connection. Input port flange 112 includes an alignment hub outer surface 112*b* and a radial line conducting surface 112*a*.

In the illustrated embodiments, the power divider-combiner 100 further includes a sidewall or exterior ground conductor 105 that has a central aperture receiving conductor 103, with a gap between the ground conductor 105 and the conductor 103. The output RF connectors 101 are angularly spaced apart relative to each other, mounted to the sidewall 105, and their center conductors 102 pass through the sidewall 105. Further, the RF connector center conductors 102 define respective axes that are all perpendicular to coincident cylinder axes defined by the conductors 106 and 109, in some embodiments.

The power divider-combiner 100 further includes a forward flange 104 that is electrically and thermally conducting, in the illustrated embodiment. The cylindrical conductor 103 has a forward end that is electrically and thermally connected to the forward flange 104, hereafter referred to as cylinder-flange 200 (see FIG. 14), and has an inner surface 103*b* spaced apart from cylinder conductor 106 (see FIG. 1 or 2, 6, 7 or 8, and 9).

In various embodiments, the outer surface of main center conductor 108 and the inner surface of cylindrical conductor 109, the outer surface of conductor 109 and the inner surface of cylindrical conductor 106, the outer surface of conductor 106 and the inner surface of cylindrical conductor 103 define three unit element (quarter-wave) coaxial transmission lines. The outer surface of the conductor 103 and the inner surface of the ground conductor 105 and their connection to the flange 104 define a unit element (quarter-wave at mid-band) transmission line shorted shunt stub 132 (see FIG. 18).

Figure 3:
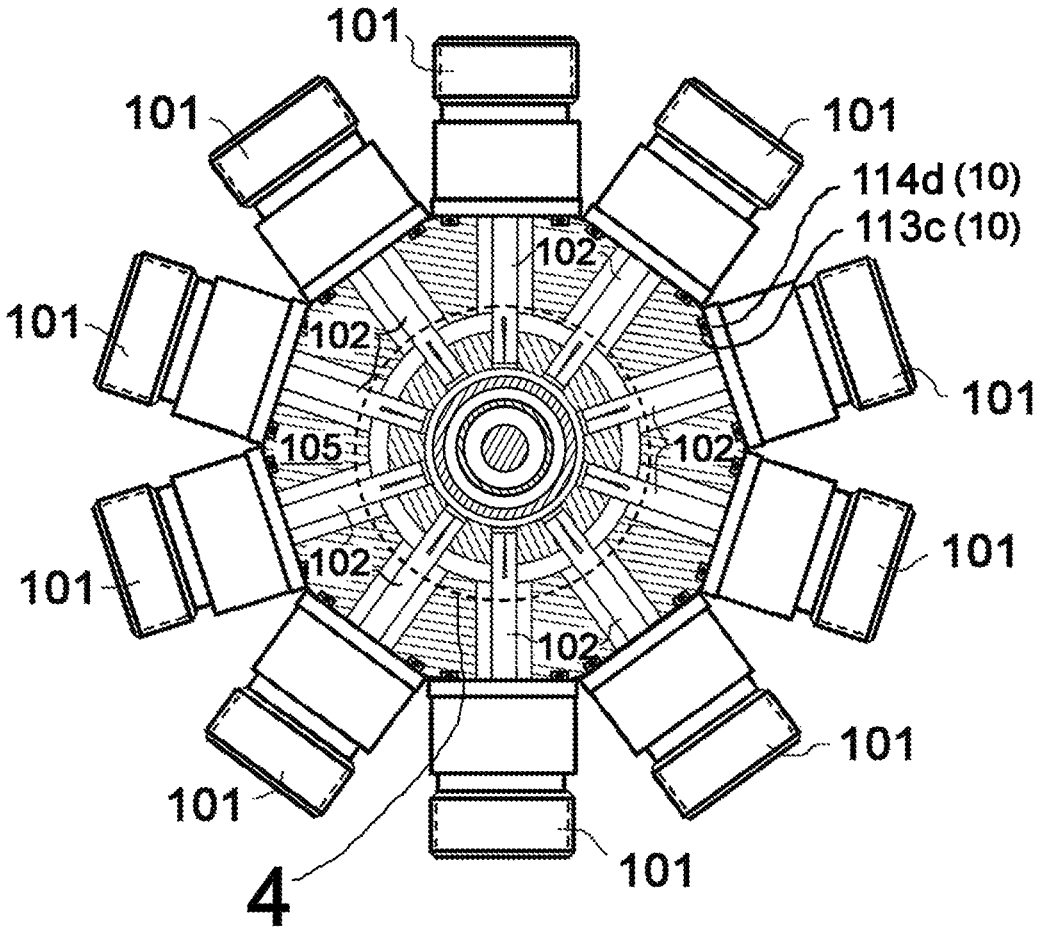
FIG. 3 is a sectional view taken along line 3-3 of FIG. 1 or FIG. 2.
Figure 4:
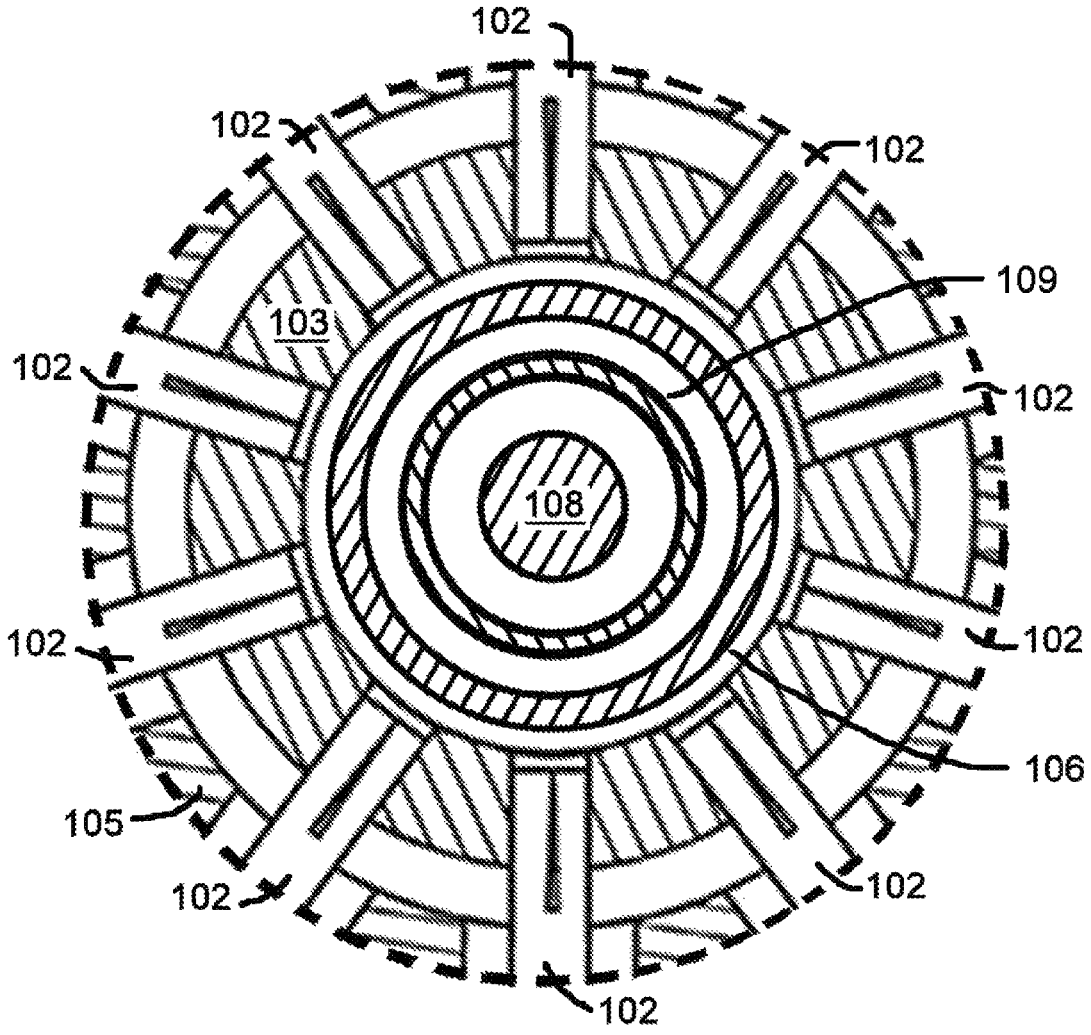
FIG. 4 is a partial cut-away view of the divider-combiner of FIG. 3.

In the illustrated embodiments, FIG. 1 shows the power divider-combiner 100 further includes a circular O-ring groove 113*a* in a forward surface of input port flange 112, and an O-ring 114*a* in the groove 113*a*, so the O-ring 114*a* sits between and engages the input port flange 112 and the input RF connector 209. Instead of a groove, in the illustrated embodiments, the input flange 112 has a circular 45 degree chamfer 115 in a rearward facing radially exterior cylindrical surface, and the power divider-combiner 100 further includes an O-ring 114*b* residing within the chamfer 115, so the O-ring 114*b* sits between and engages input flange 112 and a forward facing surface 104*c* (FIG. 14) within flange 104. In the illustrated embodiments, the power divider-combiner 100 further includes a circular O-ring groove 113*b* in a forward surface of ground conductor 105, and an O-ring 114*c* in the groove 113*b*, so the O-ring 114*c* sits between and engages the ground conductor 105 and the flange 104. In the illustrated embodiments, the power divider-combiner 100 further includes angularly spaced-apart circular O-ring grooves 113*c* in an outer surface of the sidewall 105, and O-rings 114*d* in the grooves 113*c*, so the O-rings 114*d* sit between and engage the sidewall 105 and the output port connectors 101. The grooves 113*c* and O-rings 114*d* are also shown in FIG. 3. Instead of a groove, in the illustrated embodiments, the outer back plate 107 has a circular 45 degree chamfer 116 in a forward facing radially exterior cylindrical surface, and the power divider-combiner 100 further includes an O-ring 114*e* in the chamfer 116, so the O-ring 114*e* sits between and engages the outer back plate 107 and a rearward facing surface of the sidewall 105. In the illustrated embodiments, O-ring 114*f* engages a circular O-ring groove 113*d* located within the head of cap screw SC5 (see FIGS. 11, 12, and 21) and sits between the rear back plate 107 and the head of cap screw SC5. In the illustrated embodiments, O-ring 114*g* engages a circular O-ring groove 113*e* located within the head of cap screw SC3 (see FIGS. 11, 13, and 21) and sits between input flange 112 and the head of cap screw SC3. In the illustrated embodiments, O-ring 114*h* engages a circular O-ring groove 113*f* located within the head of cap screw SC4 (see FIGS. 11, 22, and 21) and sits between rear flange 107 and the head of cap screw SC4.

It should be apparent that when an O-ring is provided in a groove of one component that faces another component, the groove could instead be provided in the other component. For example, the groove 114*c* could be provided in the rearward face of flange 104 instead of in the forward face of ground conductor 105. Also, an O-ring groove containing an O-ring may be included within the flange of input RF connector 209, thereby eliminating the need for O-ring groove 113*a* and O-ring 114*a*. Additionally, an O-ring groove containing an O-ring may be included within the flange of output RF connector 101, thereby eliminating the need for O-ring groove 113*c* and O-ring 114*d*.

In the illustrated embodiments, the power divider-combiner 100 further includes threaded bores or apertures 118 extending inwardly from the radially exterior cylindrical surface of the sidewall 105. In the illustrated embodiments, the divider-combiner 100 further includes smaller diameter bores or apertures 119, aligned with the bores 118, and extending from the bores 118 to a gap between the sidewall 105 and the cylindrical conductor 103. In the illustrated embodiments, there are two bores 118 and they are ⅛ NPT threaded bores. In the illustrated embodiments, the power divider-combiner 100 further includes threaded sealing plugs 117 threadedly received in the bores 118. One or both of the plugs 117 may be removed and replaced with a pressure valve such as, for example, a Schrader (e.g., bicycle tube) pressure valves so that dry Nitrogen or arc suppression gas mixture may be introduced into the interior of the divider-combiner 100 via the bores 119. Other types of pressure valves may be used, such as Presta or Dunlop valves, for example.

There are several reasons why the O-rings 114*a-h*, threaded bores 118, bores 119, and plugs 117 are advantageous. In FIG. 1, with both plugs 117 replaced with Schrader valves by the customer, dry Nitrogen can be introduced through one Schrader valve and allowed to exit the other Schrader valve so as to purge moisture-laden air from the sealed divider/combiner interior.

Higher-pressure gas, introduced by means of the Schrader valves and an external gas source connection 221 (FIG. 2), increases the air dielectric breakdown strength within the divider-combiner 100. The entire system including cables may then withstand higher microwave power transmission.

In some microwave radar and countermeasure systems used in fighter aircraft, the microwave waveguide and cable system components are pressurized at ground level. For example, in FIG. 2 the Type N input connector O-ring 114*a* and the cable 222 which connects to it completely seals the forward end of the divider-combiner. Both plugs 117 may be replaced with Schrader valves 120 and the divider-combiner interior then purged with moisture-free pressurized nitrogen or other pressurized gas mixture. Then the gas feed connection 221 is removed, the Schrader valves 120 are capped, and the divider/combiner 100 is expected to hold pressure for the duration of the flight mission. The O-rings 114*a-h* help maintain this interior pressure.

The O-rings 114*a-h* provide containment of high-breakdown strength gas, such as sulfur hexafluoride. The O-rings 114*a-h* keep this expensive (and possibly toxic) gas contained in the divider-combiner 100. The divider-combiner 100 with O-rings 114*a-h* and built with a Type N or Type SC input connector 209 is sealed, in some embodiments. There are no ventilation holes in the connector dielectric. The divider-combiner 100 then must use two Schrader valves 120 mounted so that the divider-combiner's interior may be successfully filled with the arc-protection gas compound.

Referring to FIG. 1, the electrical short 104*a* is located at reference plane a-a, and the shorted shunt stub 132 (see FIG. 18) makes connection to the output connector center conductors 102 at reference plane b-b.

Figure 18:
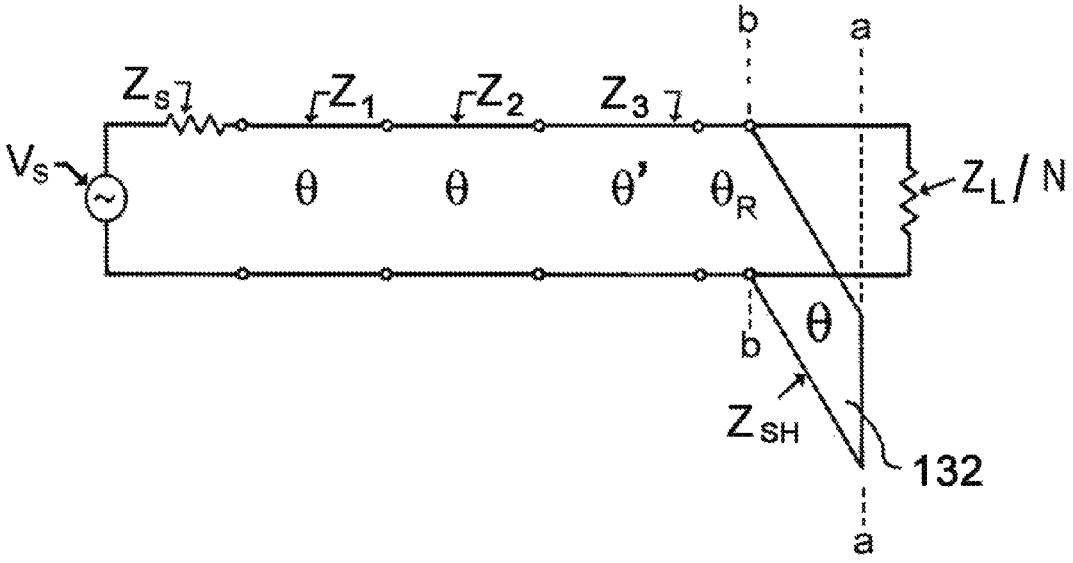
FIG. 18 is an equivalent circuit diagram for the divider/combiner shown in FIG. 1 or FIG. 2, when it is operated as a power divider.

Collectively, the three unit element transmission lines with characteristic impedances $Z_1$, $Z_2$, and $Z_3$ and the shorted shunt stub section with characteristic impedance $Z_{SH}$ are electrically modeled, in a generalized form, as a passband filter equivalent circuit shown in FIG. 18. A passband is a portion of the frequency spectrum that allows transmission of a signal with a desired minimum insertion loss by means of some filtering device. In other words, a passband filter passes a band of frequencies to a defined passband insertion loss vs. frequency profile. Desired filter passband performance is achieved by a four-step process:

1) Given a source impedance quantity $Z_S$, divider quantity (number of outputs) N, load impedance quantity $Z_L$ IN and desired passband a) bandwidth, and b) input port return loss peaks within the passband, calculate the unit element transmission line characteristic impedances $Z_1$, $Z_2$, $Z_3$ and unit element shorted shunt stub characteristic impedance value $Z_{SH}$ (see FIG. 18). This may be accomplished, as one approach, using the design theory as described in M. C. Horton and R. J. Wenzel, "General theory and design of quarter-wave TEM filters," IEEE Trans. on Microwave Theory and Techniques, May 1965, pp. 316-327.

2) After determining the above desired electrical transmission line characteristic impedances, then find corresponding diameters for the conductor 108, inner and outer diameters of cylindrical conductors 109, and 106, and the inner diameter of conductor 103 which define unit element characteristic impedances $Z_1$, $Z_2$, and $Z_3$. In addition, the outer diameter of the conductor 103 and the inner diameter of ground conductor 105 define the shorted shunt stub unit element characteristic impedance $Z_{SH}$. For example (referring to Section 9-9 FIG. 9), the characteristic impedance $Z_1$ is defined according to the formula $Z_1=60*\log_e(R_b/R_a)$ where quantity $R_b$ is the radius of the inner surface 109*b* of the conductor 109, and where quantity $R_a$ is the radius of the outer surface of the main center conductor 108. The characteristic impedance $Z_2$ is defined according to the formula $Z_2=60*\log_e(R_d/R_c)$ where quantity $R_d$ is the radius of the inner surface 106*b* of the conductor 106, and where quantity $R_c$ is the radius of the outer surface 109*a* of conductor 109. The characteristic impedance $Z_3$ is defined according to the formula $Z_3=60*\log_e(R_f/R_e)$ where quantity $R_f$ is the radius of the inner surface 103*b* of the conductor 103, and where quantity $R_e$ is the radius of the outer surface 106*a* of conductor 106. Similarly, the characteristic impedance $Z_{SH}$ is defined according to the formula $Z_{SH}=60*\log_e(R_h/R_g)$ where quantity $R_h$ is the radius of the inner surface of the ground conductor 105, and quantity $R_g$ is the radius of the outer surface 103*a* of conductor 103. The above expressions for impedances $Z_1$, $Z_2$, $Z_3$ and $Z_{SH}$ assume air or vacuum-dielectric, but other dielectric materials may be used along the lengths of unit element transmission lines corresponding to $Z_1$, $Z_2$, $Z_3$, and $Z_{SH}$, such as (but not limited to) Teflon, boron nitride, beryllium oxide, or diamond, for example.

Figure 14:
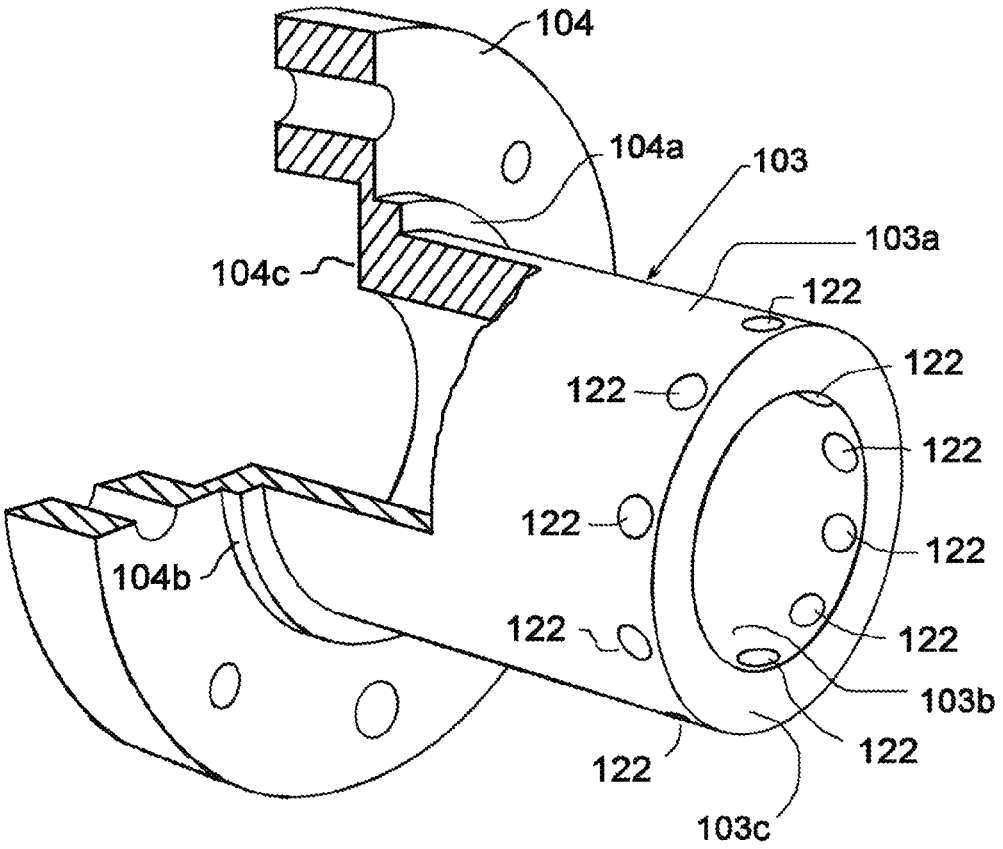
FIG. 14 is a perspective view of a conductor included in the divider/combiner of FIG. 1, partly in section.
Figure 16:
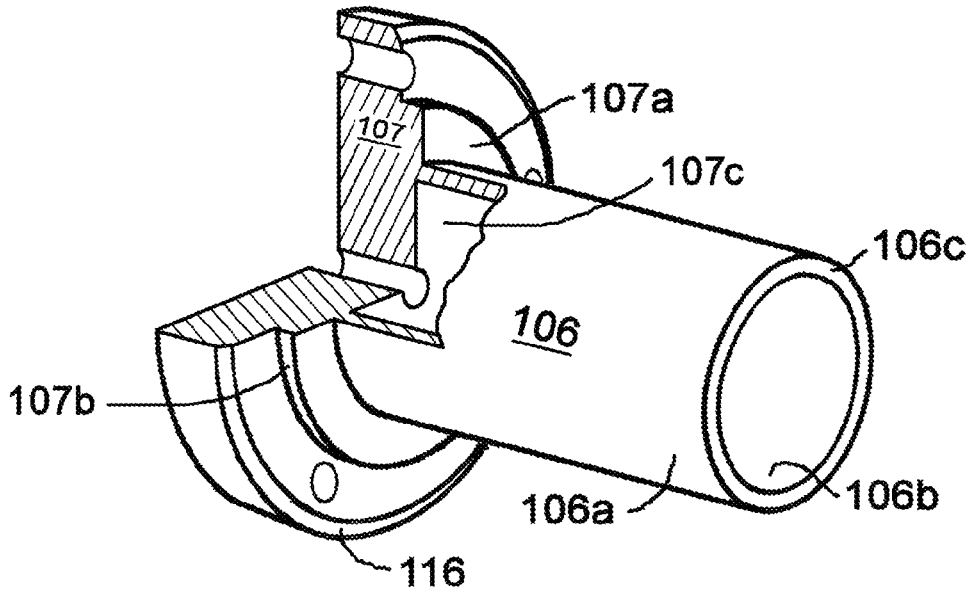
FIG. 16 is a perspective view of a conductor included in the divider/combiner of FIG. 1, partly in section.
Figure 23:
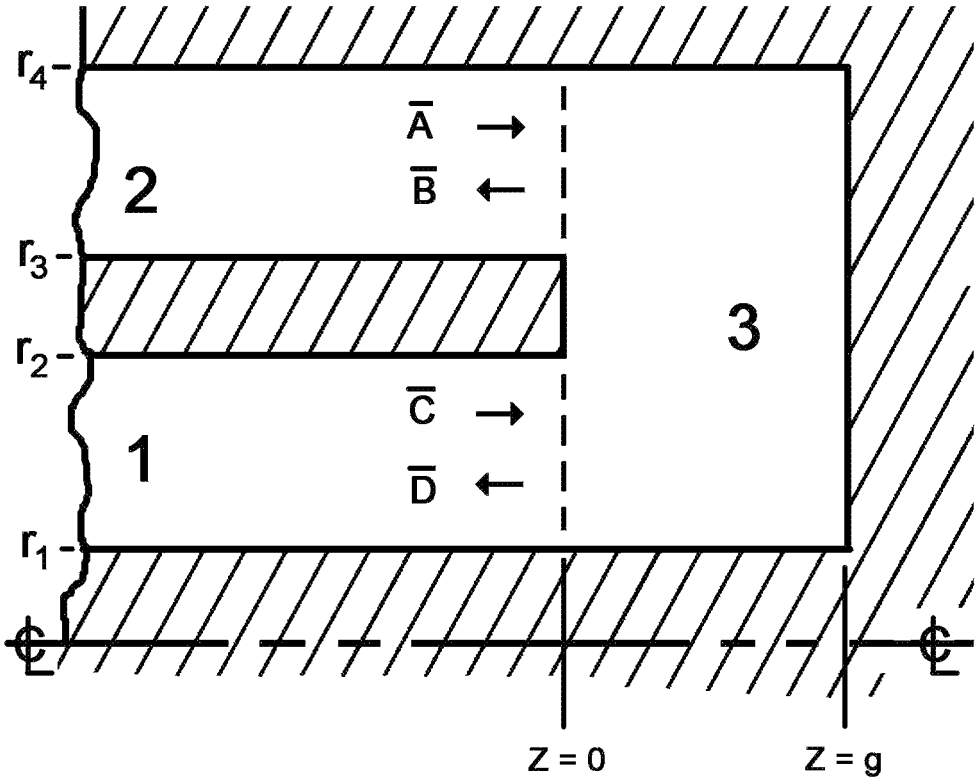
FIG. 23 is a section of nested coaxial line that defines mode amplitude reflection coefficients.

3) Referring to FIG. 5 or 6, 15 and the equivalent circuit FIG. 18, the radial transmission line gap 125 formed between conductor surfaces 109*c* and the forward facing surface 107*c* of back plate 107 is adjusted so that the magnitude of the complex reflection coefficient at this junction is made as close as possible to the quantity $(Z_1/Z_2-1)/(Z_1/Z_2+1)$ over the passband frequency range $F_1$ to $F_2$. Referring to FIG. 7 or 8 and 16, the radial transmission line gap 126 formed between conductor surfaces 106*c* and the rearward facing surface 112*a* of input flange 112 is adjusted so that the magnitude of the complex reflection coefficient at this junction is made as close as possible to the quantity $(Z_2/Z_3-1)/(Z_2/Z_3+1)$ over the passband frequency range F1 to F2. Referring to FIG. 5 or 6 and 14, the radial transmission line gap 124 formed between conductor surfaces 103*c* and the forward facing surface 107*a* of back plate 107 is adjusted so that the magnitude of the complex reflection coefficient at this junction is made as close as possible to the quantity $(Z_{SH}/Z_3-1)/(Z_{SH}/Z_3+1)$ over the passband frequency range F1 to F2. FIG. 23 shows two nested coaxial transmission lines 1 (inner line) and 2 (outer line) with a third shorted coaxial line. All three coaxial lines are each modeled using a combination of propagating TEM and evanescent TM modes. Complex reflection coefficients $\rho_1$ and $\rho_2$ at a nested coax junction (see FIG. 23) may be modeled, as one approach, by first using a field analysis formalism as presented by J. R. Whinnery, H. W. Jamieson, and T. E. Robbins, "Coaxial line discontinuities," Proceedings of the I.R.E., Nov. 1944, pp. 695-710, and then creating a mode-matching amplitude matrix M (FIG. 23) using the formalism as presented by H. Patzelt, and F. Arndt, "Double-plane steps in rectangular waveguides and their application for transformers, irises, and filters," IEEE Trans. Microwave Theory Tech., vol. MTT-30, pp. 771-776, May 1982.

4) Determining at each coax line junction the complex reflection coefficients $\rho_1$ and $\rho_2$ in the manner described above, the phases $\varphi_1$ and $\varphi_2$ at each successive nested junction are used to adjust the physical length of each coax transmission line (with respective characteristic impedances $Z_1$, $Z_2$, $Z_3$, and $Z_{SH}$) to preserve unit element phase length for each section. This may be accomplished, as one approach, using the technique outlined in FIGS. 6.08-1 "Length corrections for discontinuity capacitances," from G. Matthaei, L. Young, and E. M. T. Jones, *Microwave Filters, Impedance-matching Networks, and Coupling Structures*, Artech House Books, Dedham, M A, 1980.

Figure 19:
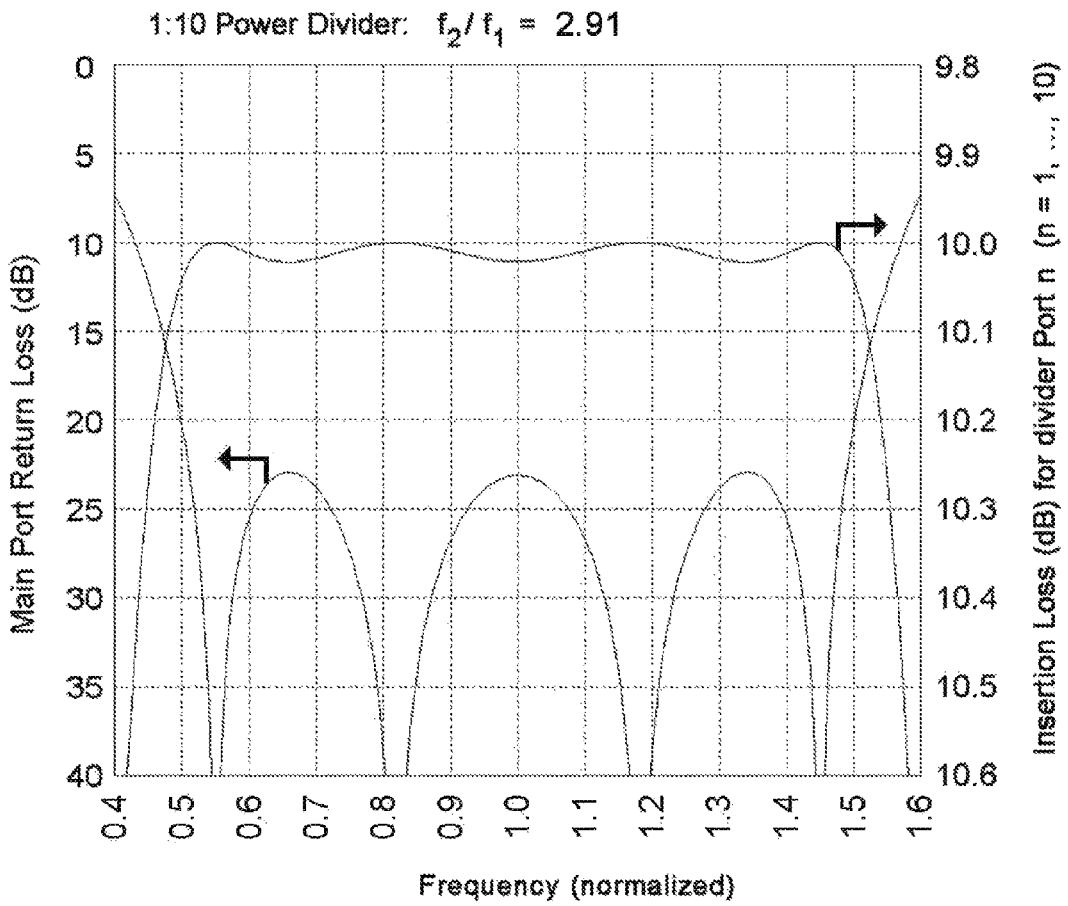
FIG. 19 is a graph showing typical input port return loss and output port insertion loss vs. frequency for embodiments of the divider-combiner of FIG. 1 or FIG. 2 that have one input port and ten output ports (when being used as a power divider).

As an example, given: N=10, $Z_S=Z_L=50$ ohms, 23 dB return loss peaks are desired for a bandwidth $F_2/F_1=2.91$, where $F_1$, $F_2$ represent the lower and upper edges of the passband, respectively. Using the Horton & Wenzel technique, unit element characteristic impedances $Z_1$, $Z_2$, $Z_3$ and the shorted shunt stub unit element characteristic impedance value $Z_{SH}$ were found. FIG. 19 shows calculated response using the derived characteristic impedances of the equivalent circuit in FIG. 18. Cross-section dimensions throughout the filter device were then determined so as to achieve these unit element characteristic impedances. The radial line gaps 124, 125, and 126 (FIG. 4 or 5, and 6 or 7) were optimized to give as closely as possible the correct magnitude (as stated earlier) of the complex reflection coefficients calculated for each unit element junction, and the physical lengths of each unit element were adjusted to achieve quarter-wave phase length at mid-band. For example, a quarter-wave length at, for example, a mid-band frequency of 1.75 GHz is equal to 1.686 inches. The length between reference plane b-b and the forward-looking face of main center conductor 108 is 1.450" for the divider-combiner 100 (FIG. 1). In comparison, for a non-nested design, the length would be at least 4.7 inches. The calculated scattering parameters $S_{11}, \ldots, S_{n1}$ plotted in FIG. 19 characterize a Chebyshev filter response throughout the passband $F_1$ through $F_2$. The Horton & Wenzel technique can also be used to find different values for $Z_1$, $Z_2$, $Z_3$, and $Z_{SH}$ to achieve other types of filter response such as, for example, maximally flat filter response.

Figure 20:
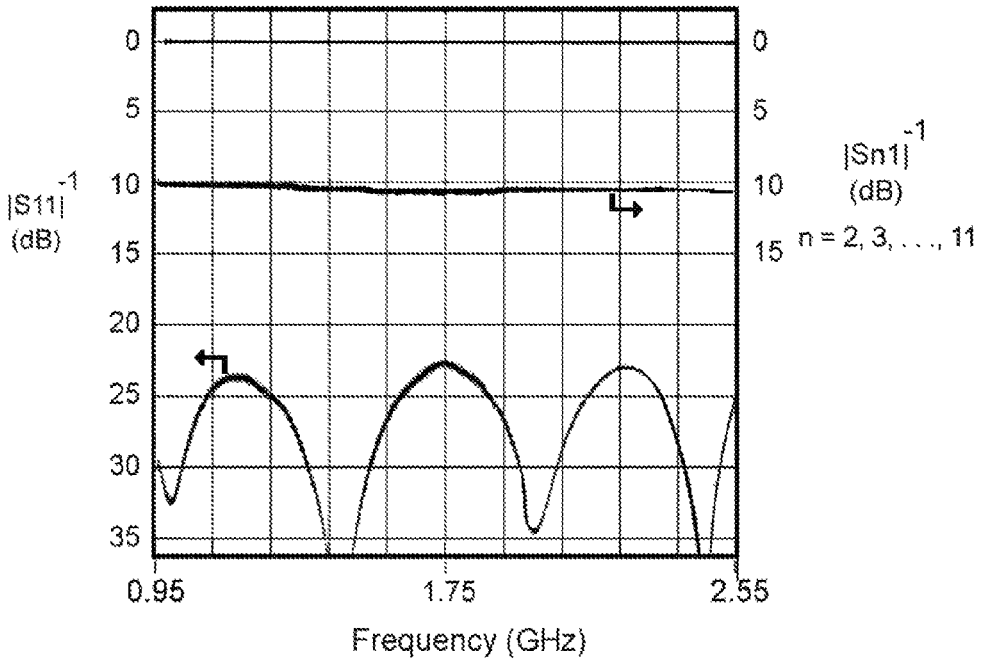
FIG. 20 is a graph showing typical input port return loss and output port insertion loss vs. frequency for embodiments of the divider-combiner of FIG. 1 or FIG. 2 that have one input port and ten output ports (when being used as a power divider).

FIG. 20 shows measured RF performance of the divider-combiner of FIG. 1. Tested as a power divider, measured RF performance shows good correlation with predicted main port return loss $-20*\log_{10}(|S_{11}|)$ (dB) and typical output port insertion loss $-20*\log 10(|S_{n1}|)$ (dB) vs. frequency.

Various conductive materials could be employed for the conductive components of the power divider-combiner 100. For example, in some embodiments, the parts (other than those parts for which materials have been already described) are fabricated from 6061 alloy aluminum. For corrosion resistance, some of these parts may be a) alodine coated, or b) electroless nickel flash-coated and MILspec gold plated. In other embodiments, parts are made of brass or magnesium alloy, also MILspec gold plated. Another possibility is MILspec silver plated, with rhodium flash coating to improve corrosion resistance.

Figure 10:
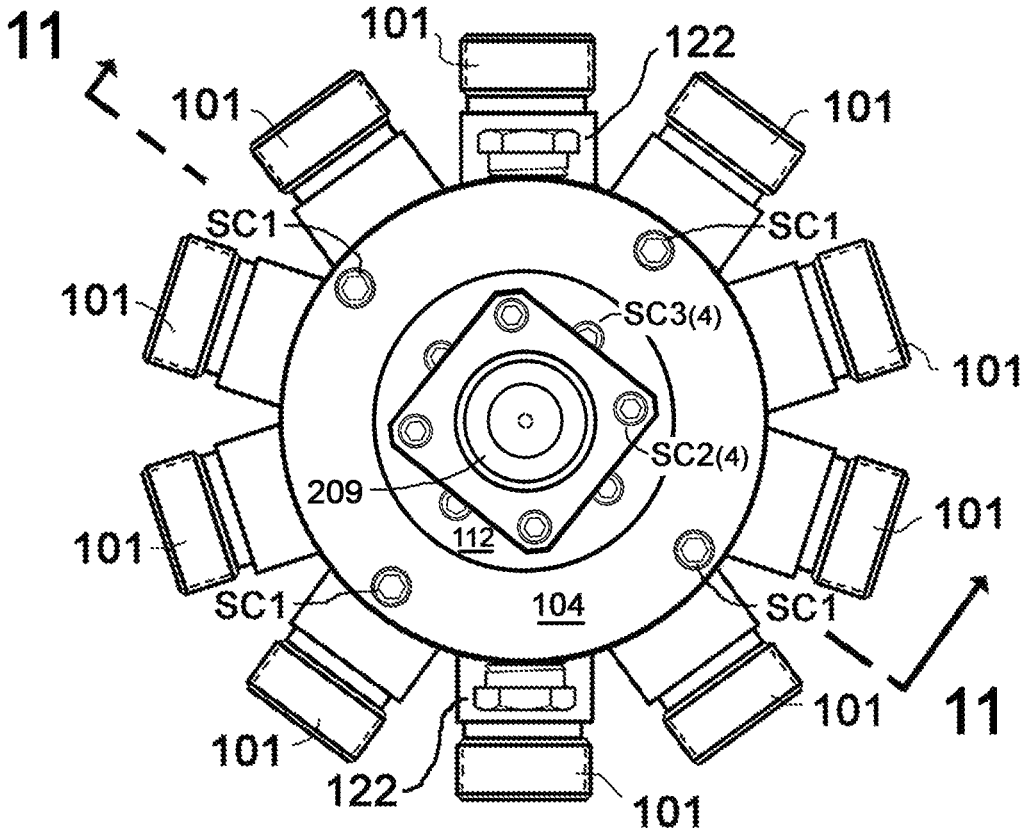
FIG. 10 is an end view of the divider/combiner of FIG. 1.
Figure 13:
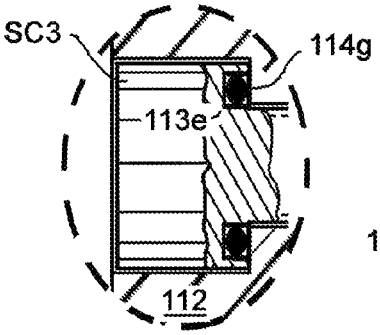
FIG. 13 is a partial cutaway view of embodiments of the divider/combiner of FIG. 11 including a cap screw O-ring seal.
Figure 12:
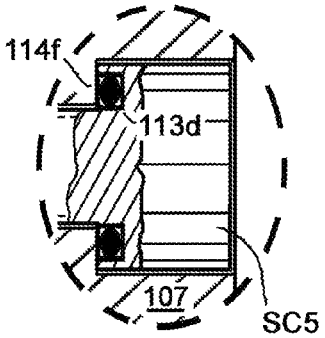
FIG. 12 is a partial cut-away view of embodiments of the divider/combiner of FIG. 11 including a cap screw O-ring seal.
Figure 22:
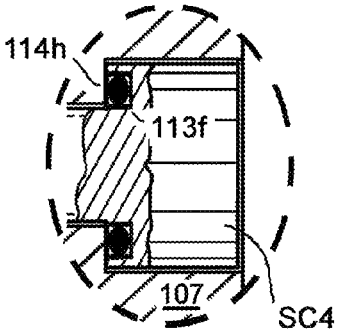
FIG. 22 is a partial cutaway view of embodiments of the divider/combiner of FIG. 11 including a cap screw O-ring seal.
Figure 11:
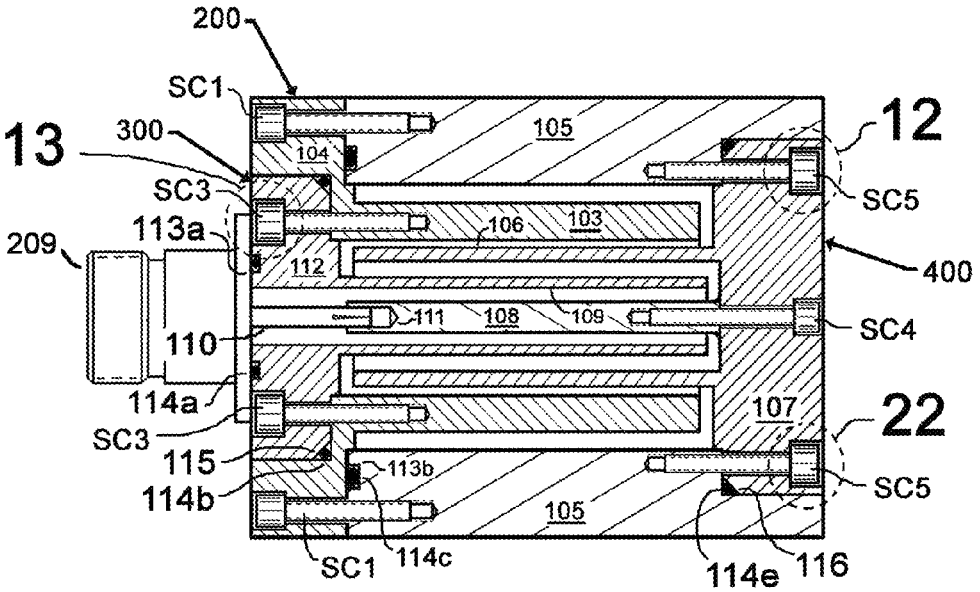
FIG. 11 is a sectional view taken along line 11-11 of FIG. 10.
Figure 21:
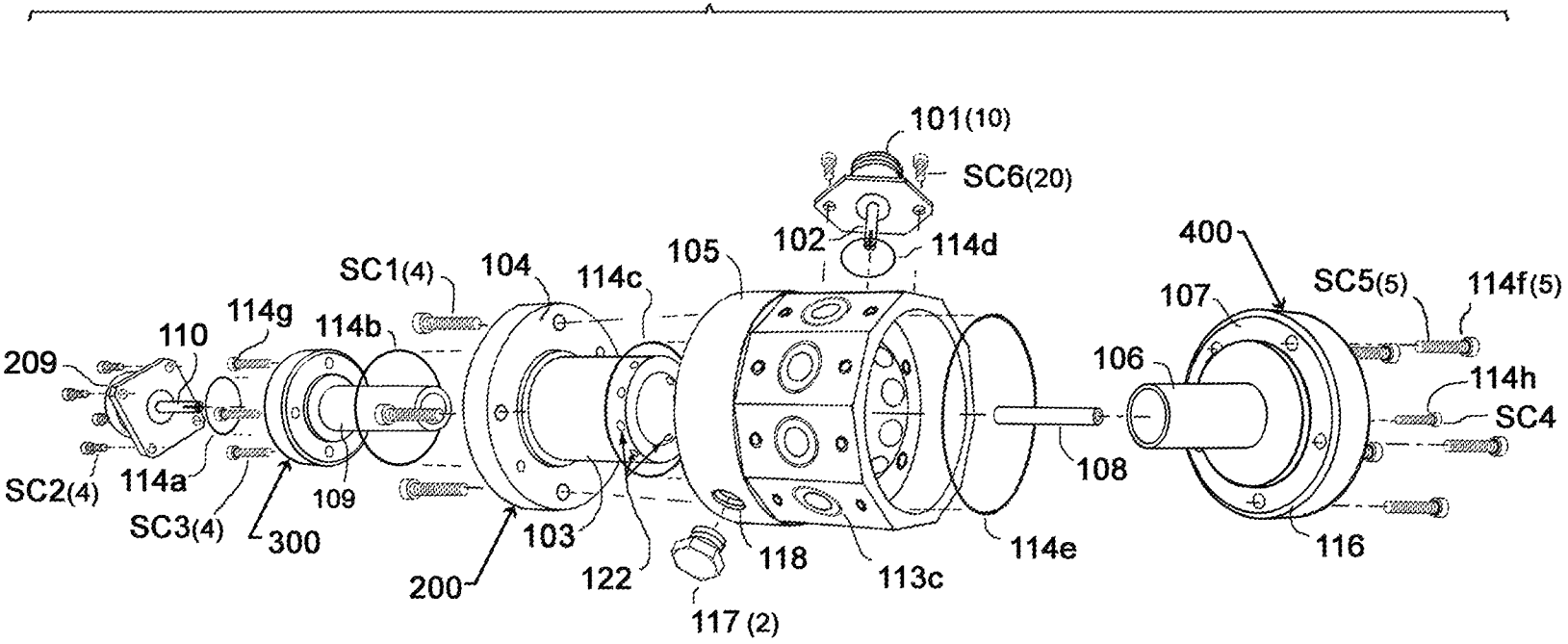
FIG. 21 is an exploded perspective view of the power divider/combiner as shown in FIG. 1.

To better enable one of ordinary skill in the art to make and use various embodiments, FIG. 21 is an exploded view of the power divider-combiner 100 of FIG. 1. In the illustrated embodiments (see FIGS. 10, 11, and 21), the flange-cylinder assembly 200 is mounted with four 8-32×0.625" socket head screws SC1 to the forward face of outer ground conductor 105. In the illustrated embodiments (see FIGS. 10, 21), the Type N female RF connector 209 is mounted with four 4-40×0.25" socket head cap screws SC2 to the input connector flange 112. Referring to FIGS. 11, 12, and 21, five 6-32×0.625" socket head screws SC5 each include an O-ring 114*f* contained in a groove 113*d* machined into the head of the cap screw (FIG. 12). Referring to FIGS. 11, 13, and 21, four 4-40×0.50" socket head screws SC3 each include an O-ring 114*g* contained in a groove 113*e* machined into the head of the cap screw (FIG. 13). Referring to FIGS. 11, 22, and 21, a single 2-56×0.625" socket head screw SC4 includes an O-ring 114*h* contained in a groove 113*f* machined into the head of the cap screw (FIG. 22). In some embodiments, the screws SC3, SC4, and SC5 that are employed are obtained from ZAGO Manufacturing. In some embodiments, other types of screw fasteners can be used such as, for example, button head cap screws. Other fastener thread sizes, lengths, and materials or attachment methods can be employed.

The main center conductor 108 is bolted to surface 107*c* of the rear flange 107 using a single 2-56×¾" stainless steel cap screw SC4 (FIG. 1 or 2, 11, 16, and 21). Other size screws or other methods of attachment can be employed. Additionally, conductor 108 and rear flange 107, both which may be plated for soldering, are shown in FIG. 5 or 6 with solder fillet 127 after soldering, so as to improve thermal and electrical contact at this connection.

FIG. 14 shows a perspective view of a flange-cylinder assembly 200 in accordance with various embodiments. In the illustrated embodiments, the flange cylinder assembly 200 includes the conducting flange 104 and the conductor 103. In the illustrated embodiments, the flange 104 and the conductor 103 are machined from a common piece. In alternative embodiments, the flange 104 and conductor 103 are separate pieces that are thermally and electrically connected together. The conductor 103 is bolted, soldered, or brazed, or press fit onto conducting flange 104 in alternative embodiments. The conductor 103 includes an outer conductive surface 103*a* that is cylindrical or generally cylindrical in the illustrated embodiments. The conductor 103 further includes an inner conductive surface 103*b* that is cylindrical or generally cylindrical in the illustrated embodiments. The flange cylinder assembly 200 includes a first end defined by the flange 104 and a second end 103*c*, defined by the conductor 103. The end 103*c* defines a radial line conductor surface. The flange 104 includes an alignment hub outer surface 104*b* and a short circuit conducting surface 104*a*. The outer surface 104*b* has an outer cylindrical surface having a diameter that is larger than the diameter of the outer cylindrical surface 103*a* of the conductor 103. The flange 104 also has an outer cylindrical surface having a diameter greater than the diameter of the surface 104*b*. Previously described apertures 122 for receiving center conductors 102 are shown.

Figure 17:
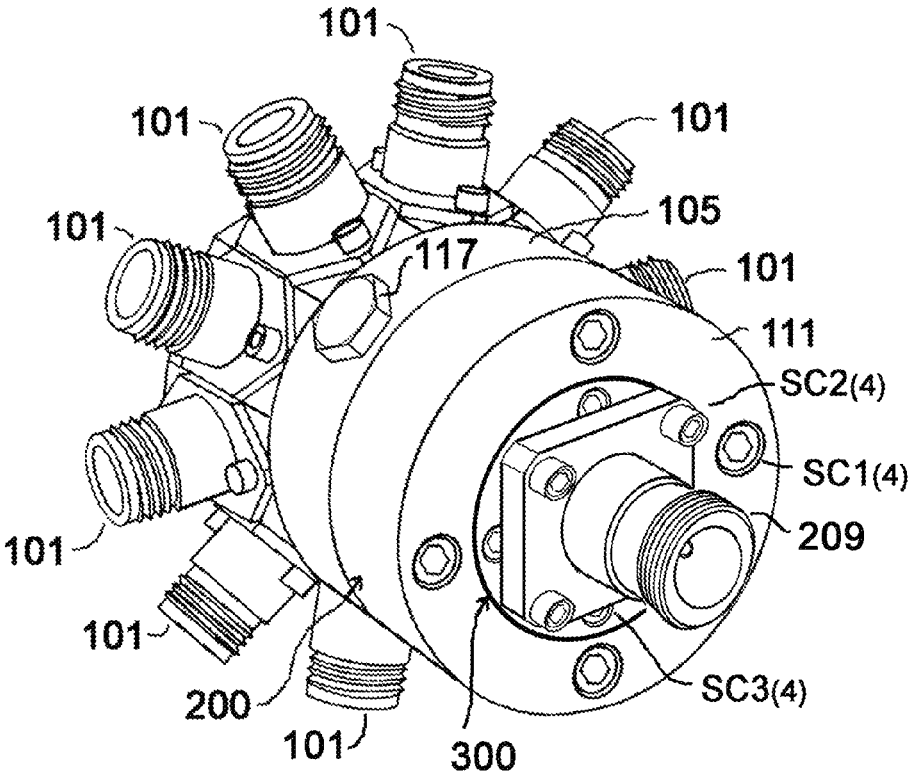
FIG. 17 is a perspective view of the divider-combiner of FIG. 1.

FIG. 17 shows a perspective view of the power divider-combiner 100 of FIG. 21 after assembly.

In the filter circuit synthesis technique as presented in the Horton & Wenzel reference, a desired circuit response (return loss over a passband as shown in FIG. 16, for example) results from the synthesis of transmission line characteristic impedances for a sequence of one or more unit element (substantially quarter-wave at the mid-band frequency $f_O$) transmission lines followed by a unit element shorted shunt stub transmission line connected in parallel with circuit load $Z_L/N$, as shown in FIG. 18 for this example.

Referring to FIG. 1 or 2, 3, 4, and 5 and the equivalent circuit shown in FIG. 18, the inner conductor 108 and the inner surface 109*b* of conductor 109 form a unit element (substantially quarter-wave) transmission line with characteristic impedance $Z_1$. The outer surface 109*a* of conductor 109 and the inner surface 106*b* of conductor 106 form a unit element transmission line with characteristic impedance $Z_2$. The outer surface 106*a* of conductor 106 and the inner surface 103*b* of the conductor 103 form a unit element transmission line with characteristic impedance $Z_3$, which has a unit element mid-band frequency phase length $\theta=\theta'+\theta_R$ where $\theta_R$ is the phase length of the radial transmission line 124 (FIG. 5 or 6) formed by the end 103*c* of the conductor 103 and the forward facing surface 107*a* of the rear flange 107. 1) Electrical reference plane a-a (FIG. 18) corresponds to the physical reference plane a-a shown in FIG. 1, where the flange 104 conducting surface 104*a* in FIG. 14 serves as the short circuit for a unit element shorted shunt stub 132 (FIG. 18). 2) Electrical reference plane b-b (FIG. 18) corresponds to the physical reference plane b-b shown in FIG. 1, where the shorted shunt stub 132 (FIG. 18) connects in parallel with output termination impedance quantity $Z_L/N$. 3) Between reference planes a-a and b-b (FIG. 18) is a unit element with characteristic impedance $Z_{SH}$. The above described unit elements are substantially one-quarter wavelength long at the passband mid-band frequency $f_O$. One way of interpreting a quarter-wavelength transmission line (at the mid-band frequency $f_O$) is that it 'transforms' the wave admittance on a Smith Chart along a circle about the origin (where the reflection coefficient magnitude is zero) exactly 180 degrees.

In the illustrated embodiments, the quantity N of output RF connectors equals ten, and the corresponding quantity N of receiving bores 122 (FIG. 5 or 6, 14, and 21) in the conductor 103 equals ten. Other values of N=2, 3, . . . , 12 or more are possible. For example, a two-way divider-combiner has quantity N=2 equally spaced receiving bores 122 (and therefore N=2 output RF connectors).

In the illustrated embodiments, the overall structure may alternatively be constructed (excluding the input connector 209 and its center conductor 110, and the ten output connectors 101 and their respective center conductors 102) using 3D printing using plastic or metal material, followed by plating with an electrically conducting material.

Divider output connectors 101 (FIGS. 1, 2, 3, 17, and 21) are shown as flange mounted Type N (female) connectors. Each output connector (only one of ten connectors 101 is shown in FIG. 21) mounts to outer conductor 105 using two 4-40×3/16" cap screws SC6 (FIG. 21). Other Type N (female, or male) mounting types and other fastener sizes and types, or mechanical attachments can be employed. Other kinds of output RF connectors, such as TNC, SMA, SC, 7-16 DIN, 4.3-10 DIN male or female, and other EIA-type flanges can be employed. Press-fit, brazed or soldered non-flanged RF connectors may also be employed.

In the illustrated embodiments, the center conductor 108 plus flange-cylinder 400 assembly is bolted to the end interior of ground conductor 105 by means of five 6-32×⅝" stainless steel O-ring-sealed cap screws SC5 (FIGS. 11, 12, 21). Other fastener sizes and types, or other mechanical attachment methods can be employed.

In various embodiments, the conductive cylinders 109, 106, and 103 are solid conducting cylinders connected thermally and electrically to respective 112, 107, and 104 thermally and electrically conductive flanges. This provides a superior thermal, electrical, and easier-to-fabricate design. Main port return loss, in some embodiments, measures approximately 23 dB or better over the frequency range 1.0 to 2.5 GHz, and divided power measures approximately −10 dB at one of the ten output ports.

In compliance with the patent statutes, the subject matter disclosed herein has been described in language more or less specific as to structural and methodical features. However, the scope of protection sought is to be limited only by the following claims, given their broadest possible interpretations. Such claims are not to be limited by the specific features shown and described above, as the description above only discloses example embodiments.

The invention claimed is:

1. A power divider/combiner having a front end and a rear end and comprising:

a main conductor defining an axis and having an outer surface;

an input connector, at the front end, having a center conductor, adapted to be coupled to a signal source, electrically coupled to the main conductor and having an axis aligned with the main conductor axis, and having a second conductor;

a first hollow cylindrical conductor having an open end facing rearwardly, having an inner cylindrical surface, and having outer cylindrical surface, the main conductor being received in and spaced apart from the inner cylindrical surface, the first hollow cylindrical conductor being electrically coupled to the second conductor of the input connector;

a second hollow cylindrical conductor having an open end facing forwardly, having an inner cylindrical surface, and having outer cylindrical surface, the first cylindrical conductor being received in and spaced apart from the inner cylindrical surface of the second cylindrical conductor;

a third hollow cylindrical conductor having an open back end facing rearwardly, having an inner cylindrical surface, and having outer cylindrical surface, the second cylindrical conductor being received in and spaced apart from the inner cylindrical surface of the third cylindrical conductor; and a plurality of output connectors having respective axes that are perpendicular to the main conductor axis, the output connectors being angularly spaced apart relative to each other, the output connectors having center conductors electrically coupled to the third cylindrical conductor.

2. A power divider/combiner in accordance with claim 1 wherein the outer surface of the main conductor and the inner surface of first cylindrical conductor, the outer surface of the first cylindrical conductor and the inner surface of the second cylindrical conductor, and the outer surface of the second cylindrical conductor and the inner surface of the third cylindrical conductor define respective unit element coaxial transmission lines.

3. A power divider/combiner in accordance with claim 2, and further comprising a ground conductor having an inner cylindrical surface, the third cylindrical conductor being received in and spaced apart from the inner cylindrical surface of the ground conductor, and comprising a unit element shorted shunt stub including the inner surface of the ground conductor and the outer surface of the third cylindrical conductor.

4. A power divider/combiner in accordance with claim 1 wherein the inner cylindrical surfaces of the first, second, and third cylindrical conductors have respective cylinder axes coincident with the axis of the main conductor.

5. A power divider/combiner in accordance with claim 1, and further comprising a ground conductor having an inner cylindrical surface, the third cylindrical conductor being received in and spaced apart from the inner cylindrical surface of the ground conductor, wherein the output conductors have respective second conductors electrically coupled to the ground conductor proximate the back end of the third cylindrical conductor.

6. A power divider/combiner in accordance with claim 5 and further comprising a rear flange, at the rear end, supporting the second cylindrical conductor relative to the main conductor, and spaced apart from the open ends of the first and third cylindrical conductors by respective gaps.

7. A power divider/combiner in accordance with claim 6 wherein the rear flange is secured to the main conductor.

8. A power divider/combiner in accordance with claim 1 and further comprising means for selectively receiving and retaining a gas.

9. A power divider/combiner having a front end and a rear end and comprising:

a main conductor defining an axis and having an outer surface;

an input connector, at the front end, having a center conductor, adapted to be coupled to a signal source, electrically coupled to the main conductor and having an axis aligned with the main conductor axis, and having a second conductor;

a first hollow cylindrical conductor having an open end facing rearwardly, having an inner cylindrical surface, and having outer cylindrical surface, the main conductor being received in and spaced apart from the inner cylindrical surface, the first hollow cylindrical conductor being electrically coupled to the second conductor of the input connector;

a second hollow cylindrical conductor having an open end facing forwardly, having an inner cylindrical surface, and having outer cylindrical surface, the first cylindrical conductor being received in and spaced apart from the inner cylindrical surface of the second cylindrical conductor;

a third hollow cylindrical conductor having an open back end facing rearwardly, having an inner cylindrical surface, and having outer cylindrical surface, the second cylindrical conductor being received in and spaced apart from the inner cylindrical surface of the third cylindrical conductor, the outer surface of the main conductor and the inner surface of first cylindrical conductor, the outer surface of the first cylindrical conductor and the inner surface of the second cylindrical conductor, and the outer surface diameter of second cylindrical conductor and the inner surface of the third cylindrical conductor define respective unit element coaxial transmission lines, and the first, second and third hollow cylindrical conductors having respective cylinder axes that are coincident with the axis of the main conductor; and a plurality of output connectors having respective axes that are perpendicular to the main conductor axis, the output connectors being angularly spaced apart relative to each other, the output connectors having center conductors electrically coupled to the third cylindrical conductor.

10. A power divider/combiner in accordance with claim 9, and further comprising a ground conductor having an inner cylindrical surface, the third cylindrical conductor being received in and spaced apart from the inner cylindrical surface of the ground conductor, wherein the output conductors have respective second conductors electrically coupled to the ground conductor proximate the back end of the third cylindrical conductor.

11. A power divider/combiner in accordance with claim 10, and comprising a unit element shorted shunt stub including the inner surface of the ground conductor and the outer surface of the third cylindrical conductor.

12. A power divider/combiner in accordance with claim 9 and further comprising a rear flange, at the rear end, supporting the second cylindrical conductor relative to the main conductor, and spaced apart from the open ends of the first and third cylindrical conductors by respective gaps.

13. A power divider/combiner in accordance with claim 12 and further comprising a screw securing the rear flange to the main conductor.

14. A power divider/combiner in accordance with claim 9 and further comprising means for selectively receiving and retaining a gas.

15. A method of manufacturing a power divider/combiner having a front end and a rear end, the method comprising:

providing a first hollow cylindrical conductor having an open end facing rearwardly, having an inner cylindrical surface, and having outer cylindrical surface, and providing an input port flange forward of the first cylindrical conductor, electrically coupled to and secured to the first cylindrical conductor;

providing a main conductor defining an axis and having an outer surface inside the inner cylindrical surface, spaced apart from the inner cylindrical surface;

securing an input connector to the input port flange, the input connector having a center conductor and being adapted to be coupled to a signal source, electrically coupling the center conductor of the input connector to the main conductor, coupling a second conductor of the input connector to the input port flange;

providing a second hollow cylindrical conductor having an open end facing forwardly, having an inner cylindrical surface, and having outer cylindrical surface, and providing a rear flange rearward of the second cylindrical conductor, electrically coupled to and secured to the second cylindrical conductor;

providing a third hollow cylindrical conductor having an open back end facing rearwardly, having an inner cylindrical surface, and having outer cylindrical surface;

receiving the first cylindrical conductor and center conductor in the third cylindrical conductor;

providing a plurality of output connectors having respective axes that are perpendicular to the main conductor axis, the output connectors being angularly spaced apart relative to each other, the output connectors having center conductors electrically coupled to the third cylindrical conductor; and inserting the second cylindrical conductor between the first and third cylindrical conductors, spaced apart from the inner surface of the third conductor and the outer surface of the first conductor.

16. A method in accordance with claim 15 wherein the output connectors have respective second connectors, the method further comprising providing a ground conductor having an inner cylindrical surface, receiving the third cylindrical conductor in the ground conductor, and securing the output connectors to the ground conductor with the second conductors of the output connectors electrically coupled to the ground conductor.

17. A method in accordance with claim 16 wherein a fluid chamber is defined in the power divider/combiner, and the method further comprising providing a threaded bore in fluid communication with the fluid chamber, and providing a threaded plug, complementary to the threaded bore, plugging the threaded bore.

18. A method in accordance with claim 15 and further comprising securing the rear flange to the main conductor.

19. A method in accordance with claim 15 and further comprising configuring the divider/combiner, using o-ring seals, to be able to retain a gas introduced via the threaded bore.

20. A method of manufacturing a power divider/combiner in accordance with claim 19 and further comprising removing the threaded plug and replacing the threaded plug with a pressure valve configured to be used to introduce a gas into the power divider/combiner.

* * * * *